US005172740A

United States Patent [19]

Simmel et al.

[11] Patent Number: 5,172,740

[45] Date of Patent: Dec. 22, 1992

[54] LIQUID FLOW CONTROL SYSTEM

[76] Inventors: Thomas L. Simmel, 44 Booras La.; Craig A. Baker, 31 Bird La., both of Milford, Conn. 06460

[21] Appl. No.: 677,494.

[22] Filed: Apr. 3, 1991

Related U.S. Application Data

[63] Continuation-in-part of Ser. No. 520,518, May 8, 1990, Pat. No. 5,058,636, which is a continuation-in-part of Ser. No. 211,811, Jun. 27, 1988, Pat. No. 4,924,921.

[51] Int. Cl.[5] ..... B67C 3/00; B65B 39/04

[52] U.S. Cl. ..... 141/321; 141/346; 141/348; 141/353; 141/354; 141/386; 141/383

[58] Field of Search ..... 141/285, 286, 290, 291–296, 141/302, 305, 308, 309, 319–321, 346–355, 357, 383, 386, 387, 198

[56] References Cited

U.S. PATENT DOCUMENTS

| | | | |
|---|---|---|---|
| 2,737,401 | 3/1956 | Lindsay | 141/346 |
| 3,168,125 | 2/1965 | Rosell | 141/346 |
| 3,171,448 | 3/1965 | Fromm | 141/346 |
| 3,190,322 | 6/1965 | Brown | 141/387 |
| 3,330,313 | 7/1967 | Rosell | 141/346 |
| 3,513,887 | 5/1970 | Limandri | 141/346 |
| 4,794,960 | 1/1989 | Hawley et al. | 141/384 |
| 4,924,921 | 5/1990 | Simmel et al. | 141/286 |
| 5,058,676 | 10/1991 | Simmel et al. | 141/346 |

*Primary Examiner*—Ernest G. Cusick
*Attorney, Agent, or Firm*—Melvin I. Stoltz

[57] ABSTRACT

By employing two independent, separate and distinct flow paths which are controllably sequentially opened during use in a single actuation operation, an error-free, spill-free flame and explosion proof liquid delivery/filling system is achieved. In the preferred embodiment, both flow paths are normally maintained in a closed, sealed configuration, requiring an actuation force to controllably, sequentially open the flow paths. In addition, by providing a cooperating, mating liquid transfer assembly, the container on which the liquid delivery/-filling system is mounted can be refilled with safety and ease, completely eliminating spillage of the liquid. In this way, a fully integrated, cooperating, liquid flow controlling system is realized.

23 Claims, 15 Drawing Sheets

FIG. 16
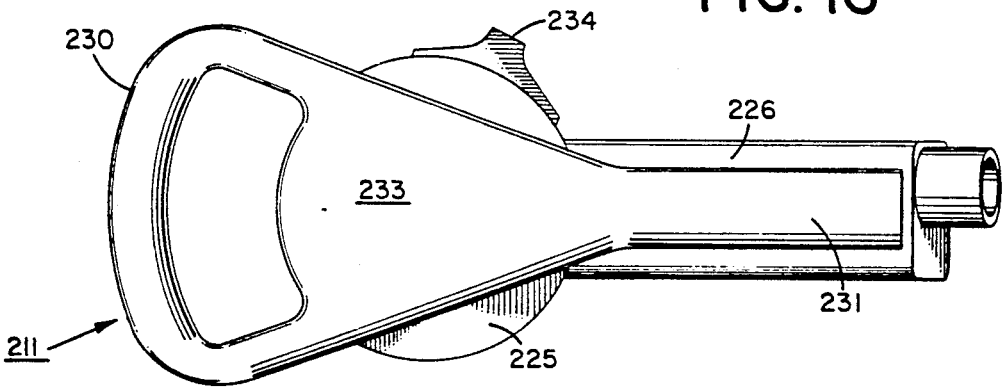
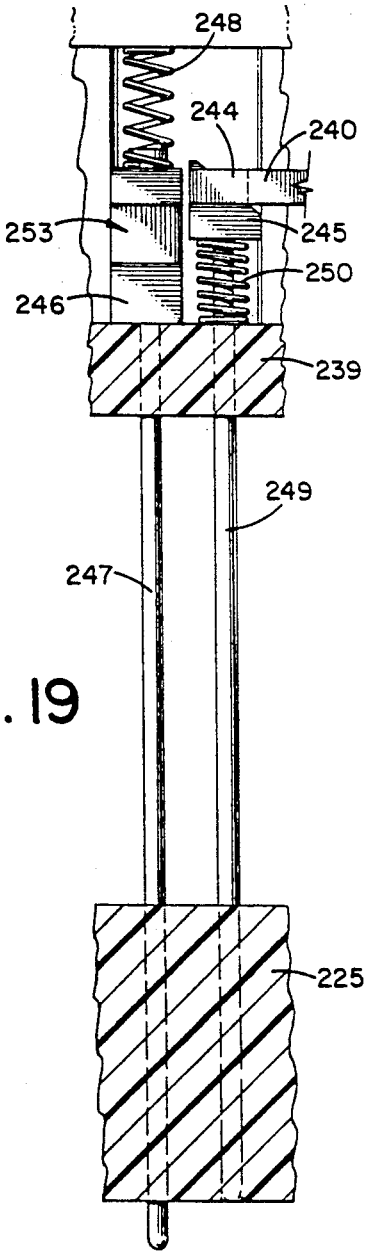
FIG. 19
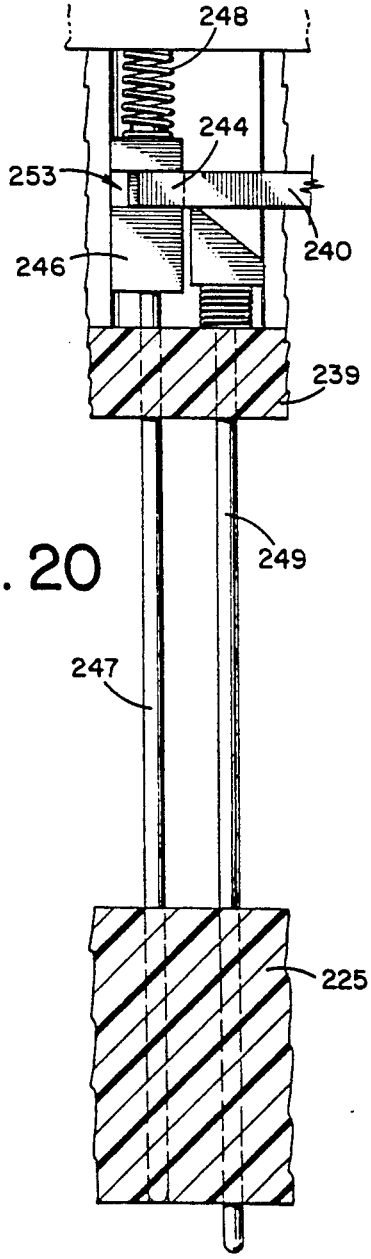
FIG. 20

LIQUID FLOW CONTROL SYSTEM

RELATED APPLICATION

This application is a continuation-in-part of U.S. Ser. No. 07/520,518, filed May 8, 1990 now U.S. Pat. No. 5,058,636 issued Oct. 22, 1991, for a Liquid Flow Control System which is a continuation-in-part patent application of U.S. patent application Ser. No. 07/211,811, filed Jun. 27, 1988, now U.S. Pat. No. 4,924,921, issued May 15, 1990, for a Liquid Delivery/Filling System.

BACKGROUND ART

For many years, safe, trouble-free delivery or transferral of various liquids, particularly flammable liquids and toxic or hazardous liquids, has long been a problem which has plagued the industry. In particular, in situations where small quantities of flammable or toxic liquids are to be transferred from a storage container to an active, useable reservoir, such as the gasoline tank of motor vehicles or a holding tank for dilution, the difficulties typically encountered with transferring flammable liquids become most acute.

In an attempt to reduce or eliminate these difficulties, various systems and adaptors have become available. However, these prior art systems have failed to eliminate the inherent danger or to overcome the problems and dangers.

The most severe problems being encountered are the spontaneous eruption of an uncontrolled fire and unwanted explosions often followed by fire. These catastrophic incidents have occurred most frequently in the rapid delivery of gasoline from a storage container to the tank or reservoir of a vehicle during an on-going race.

In such situations, particularly with racing cars, motorcycles and all terrain vehicles, speed of delivery is important. In addition, particularly with motorcycles, all terrain vehicles and small cars, the fuel tank size does not allow pressurized pump delivery systems. Consequently, gravity delivery is employed, with the desirability of high speed often leading to carelessness.

In these gravity-based delivery situations, it has been found that gasoline vapors build up in the storage container prior to use, particularly when the ambient temperatures are high or the storage tanks are left out in direct sunlight. During the rush to rapidly fill the gasoline tank for continued racing, the storage tank is inadvertently not vented prior to use. Consequently, the highly flammable, pressurized gasoline vapors are allowed to come into rapid contact with the hot motor vehicle, often causing an unwanted fire or explosion.

In addition, prior art delivery systems have failed to eliminate unwanted spillage. Consequently, gasoline is often spilled on the hot motor vehicle during the delivery process. This spillage is also very dangerous and has also resulted in unwanted fires.

Similarly, in transferring toxic or hazardous liquids, spillage continues to be a primary problem, as well as unsafe disposal of the container bearing the concentrated toxic liquid after it is used.

Although these problems and difficulties have existed in the industry for many years, no prior art system exists which completely eliminates the inherent dangers found in these liquid delivery situations.

Therefore, it is a principal object of the present invention to provide a liquid flow controlling system which is capable of controllably delivering liquid to a tank or container in a safe, error free manner.

Another object of the present invention is to provide a liquid flow controlling system having the characteristic features described above which provides positive, automatic flow control means to assure that the liquid is being delivered only when safe to do so.

Another object of the present invention is to provide a liquid flow controlling system having the characteristic features described above which substantially reduces any chance of fires or explosions during the gravity delivery of liquid from one reservoir to another.

Another object of the present invention is to provide a liquid flow controlling system having the characteristic features described above which virtually eliminates dangerous spillage of the liquid being delivered.

Other and more specific objects will in part be obvious and will in part appear hereinafter.

SUMMARY OF THE INVENTION

The present invention overcomes prior art difficulties by providing two separate and distinct flow channels both of which are controllably opened in a specific, pre-set sequence, upon actuation. In this way, the liquid delivery/filling system of the present invention assures that upon actuation the liquid is safely delivered from the first storage reservoir to the second active reservoir, while being completely closed prior to actuation.

By providing two completely independent and separate flow channels, the liquid is controllably delivered along one flow path or channel, while the second flow path or channel assures controlled removal of displaced air from the chamber being filled. In addition, the air is delivered to a zone above the liquid level. This prevents unwanted air flow or bubbling through the liquid itself, thereby eliminating one primary source of spillage.

Furthermore, by mounting the system in a normally closed position and providing the sequential controlled actuation of the two independent flow channels when desired, the liquid delivery/filling system of the present invention eliminates the second source of spillage, as well as safely controlling any vapor build up in the storage container. The present invention substantially reduces any possibility that vapor pressure build up will be accidentally ignited or that liquid will be spilled in unwanted or undesirable areas.

In the preferred construction, the two, independent flow channels are constructed concentrically, in order to provide a compact and easily useable construction. In addition, the controlled, sequential actuation is achieved in a positive, automatic error free manner. As a result, regardless of user knowledge, trouble-free use is attained.

Furthermore, the liquid delivery/filling system of the present invention incorporates flow shut-off means which automatically discontinues the delivery of the liquid to the active reservoir when the reservoir has been filled. By incorporating automatic flow shut-off means, in combination with the other features detailed above, the fluid delivery/filling system of the present invention provides for the safe transferral or delivery of flammable or toxic liquids, without the dangers and problems that have plagued the industry.

In addition, in order to provide for the safe transferral of flammable or toxic liquids from a storage container to an active, useable container or reservoir, the present invention also comprises a cooperating, mating, system-engaging refilling assembly for being lockingly mounted to the liquid delivery/filling system, securing the system in its open position and enabling the storage container to be refilled both safely and speedily. In this way, the storage container can be repeatedly reused after the safe refilling thereof, thereby enabling the liquid delivery/filling system mounted thereto to be continuously used to prevent unwanted spillage.

The integrated, interlocking mating/refilling assembly of this invention is of particular importance in assuring the safe delivery and use of toxic and hazardous chemicals and liquids, such as chemical fertilizers, pesticides and insecticides which are environmentally safe when diluted, but highly toxic or hazardous when spilled in their concentrated form. In many applications throughout the country, chemical fertilizers, pesticides and insecticides are applied to crops, plants, trees, etc. in order to either enhance their growth or reduce or eliminate the damage caused by insects or other crop feeding animals.

Typically, the concentrated toxic or hazardous chemical liquids are transferred from a liquid storage container to an active, useable reservoir in which the toxic chemical liquid is diluted for safe application to the crops, plants, trees or other farmed product. In order to assure safe, trouble-free transferral of the hazardous or toxic concentrated chemical liquids from the storage container to the active, useable reservoir, the liquid delivery/filling system of the present invention is employed.

In this particular application, it has been found that toxic or hazardous liquids have been able to cause unwanted contamination due to the discarding of the storage container used for holding the concentrated hazardous chemical liquid. Consequently, in order to eliminate this unwanted contamination, an alternate embodiment of the present invention comprises an integrated, interlocking mating/refilling assembly which cooperatingly engages the liquid delivery/filling system for enabling the storage container to be refilled. In this way, the storage container is repeatedly reused, thereby preventing its disposal and the unwanted contamination of the surrounding environment by the residual chemicals contained therein.

In order to enable the storage container to be repeatedly reused, the liquid delivery/filling system is preferably fixedly mounted to the storage container and the cooperating, integrated, interlocking mating/refilling assembly lockingly mounts to the liquid delivery/filling system, automatically causing the delivery/filling system to be fixed in its open position, enabling the safe, efficient, spill-free refilling of the storage container for subsequent reuse. In this way, the storage containers are not discarded and, thereby, do not cause contamination. Furthermore, each concentrated chemical holding storage container incorporates a liquid delivery/filling system of this invention, thereby effectively eliminating unwanted spillage of the toxic liquid contained therein.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed desciption taken in connection with the accompanying drawings, in which:

FIG. 16 is a top plan view of the liquid transfer assembly of FIG. 14;

FIG. 19 is a cross-sectional side elevation view, partially broken away, of the liquid transfer assembly showing the interlock system taken along line 9—9 of FIG. 17;

FIG. 20 is a cross-sectional side elevation view, partially broken away, showing the interlock system of the liquid transfer assembly taken along line 20—20 of FIG. 18;

DETAILED DESCRIPTION

Figure 1:
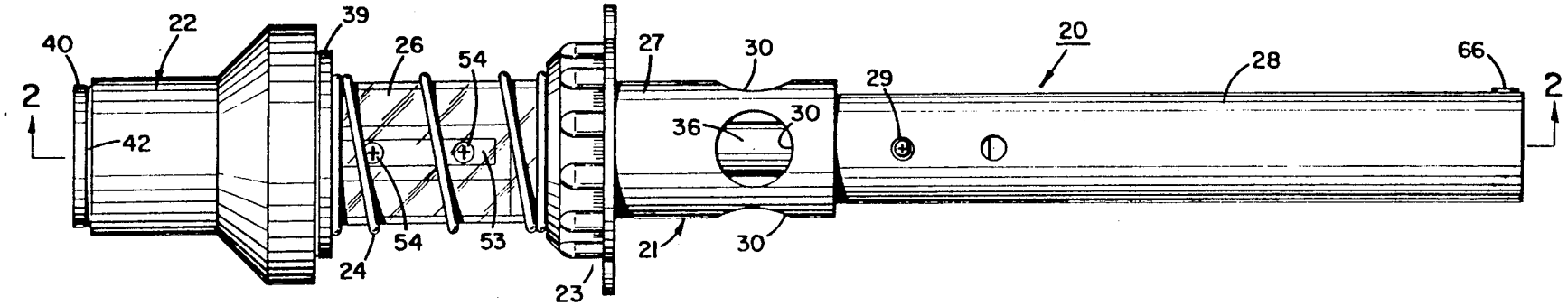
FIG. 1 is a side elevational view of the fluid delivery/filling system of the present invention shown fully assembled, and in its normally closed postion.

As shown in FIG. 1, the liquid delivery/filling system 20 of the present invention comprises an elongated, outer tube 21 to which is mounted a slidable collar 22 and a sealing cap 23. In addition, coil spring 24 is mounted about tube 21 between collar 22 and cap 23 to maintain slidable collar 22 in its fully extended, forwardmost flow sealing position.

Figure 2:
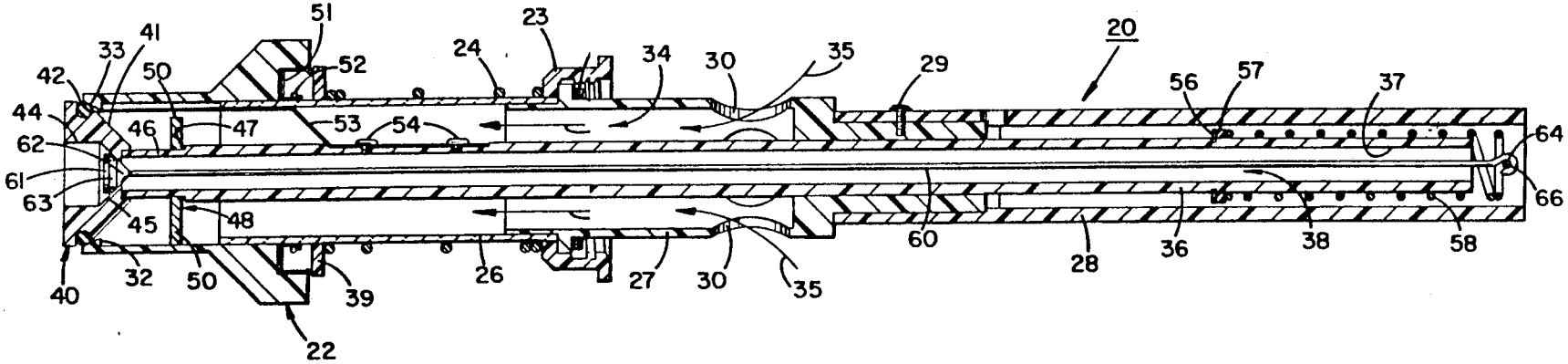
FIG. 2 is a cross-sectional side elevational view of the liquid delivery and filling system of the present invention taken along line 2—2 of FIG. 1.
Figure 3:
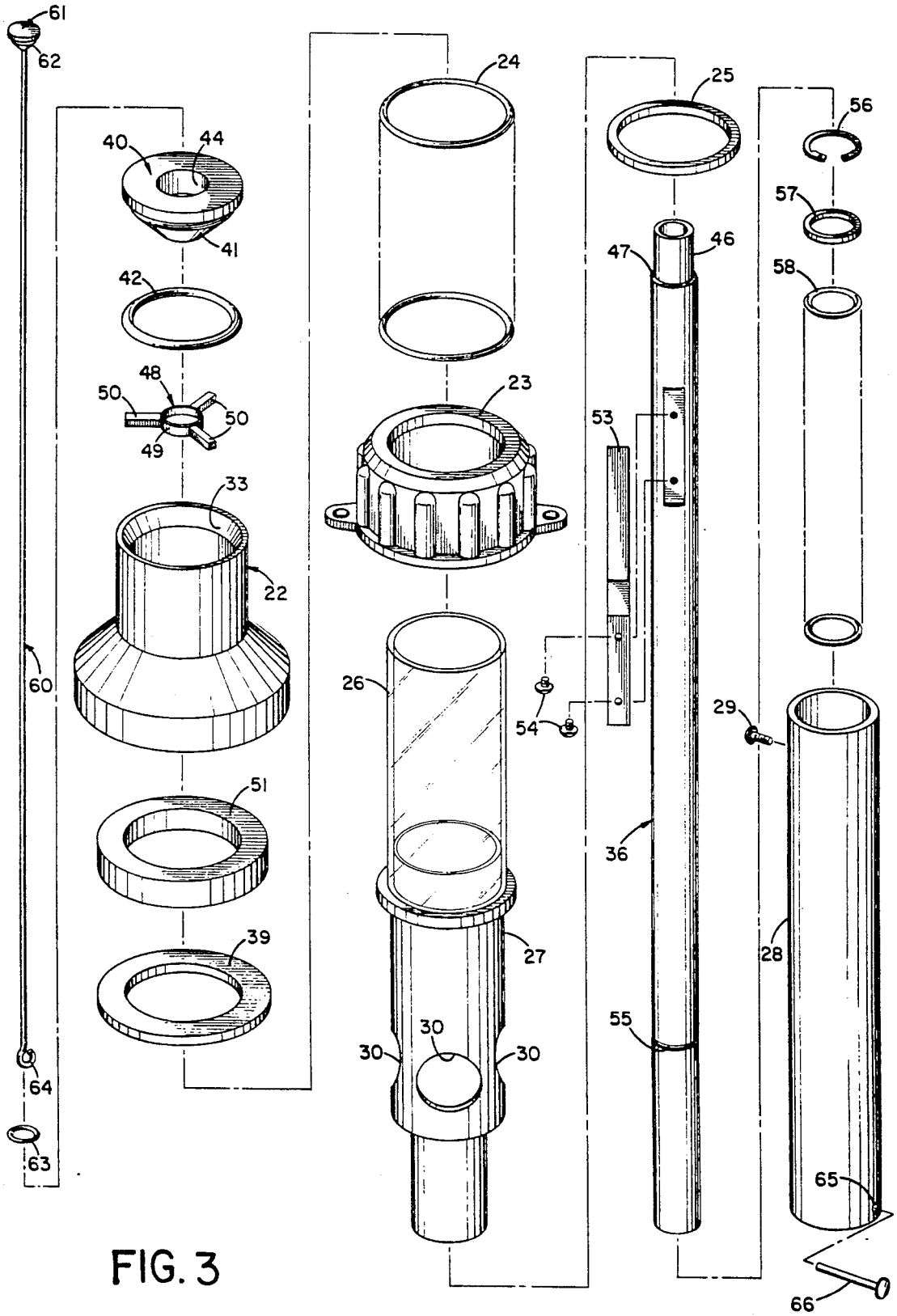
FIG. 3 is an exploded perspective view of the FLUID delivery/filling system of the present invention.

By referring to FIGS. 2 and 3, along with FIG. 1, in conjunction with the following detailed disclosure, the overall construction of liquid delivery/filling system 20 can best be understood. In the preferred construction, elongated outer tube 21 comprises three component parts. These components preferably comprise a clear, transparent section 26, a central section 27, to which transparent section 26 is fixedly mounted, and a distal section 28 which is removably mounted to central section 27 by screw means 29. In this way, distal section 28 can comprise alternate lengths, in order to cooperate with storage containers of any configuration.

In this preferred embodiment, central section 27 of elongated outer tube 21 incorporates a plurality of portals 30 formed therein. As is more fully detailed below, tube 21 defines flow path 34 along which the liquid to be transferred from the first container to the second container travels in the general direction shown by arrows 35.

In addition to outer elongated tube 21, liquid delivery/filling system 20 of the present invention also incorporates an inner elongaged tube 36. Preferably, elongated tube 36 comprises an overall length which is less than the overall length of outer tube 21. Furthermore, tube 36 is preferably concentrically mounted within elongated tube 21 as well as being slidably engaged therewith.

Inner elongated, slidably engaged tube 36 incorporates a centrally disposed, elongated bore 37 extending the entire length thereof and defining a second flow path 38 for liquid delivery/filling system 20.

At the proximal end of inner elongated tube 36, a liquid flow controlling valve 40 is securely affixed. In the preferred embodiment, valve 40 comprises a generally annular shape having a conically shaped base. As a result, valve 40 comprises an outer conical shaped surface 41, the apex end of which is securely affixed to the proximal end of tube 36. At the opposed end of conical shaped surface 41, a sealing O-ring 42 is mounted. In addition, valve 40 comprises a portal 44 and an inner conical shaped surface 45.

As clearly shown in FIG. 2, when slidable collar 32 is in its forward-biased, flow preventing position, the sloping, ramped surface 33 of collar 22 is maintained in secure, engaged, sealing contact with O-ring 42. Furthermore, collar 22 is normally held in this position by spring means 24, assuring that liquid flow through passageway 34 is prevented.

In order to prevent unwanted leakage of the liquid being transferred between the storage container and the active reservoir, slidable collar 22 incorporates a sealing ring assembly 51 securely affixed to collar 22 at the distal end thereof. In addition, sealing ring assembly 51 incorporates a coil spring 52 mounted therein which maintains a portion of sealing ring assembly 51 in biased frictional engagement with transparent section 26 of elongated tube 21. In this way, when collar 22 is in its forwardly biased sealed configuration, leakage of the liquid contained in passageway 34 is prevented.

In addition, in order to assure continuous, trouble-free axial slidability of collar 22 along transparent section 26, a washer 39 is mounted between collar 22 and spring means 24. In this way, washer 39 provides a bearing surface upon which compression spring 24 acts, as well as a solid surface for acting upon spring 24 as collar 22 is axially moved distally against the forces of spring 24.

As clearly shown in FIGS. 2 and 3, the proximal end of inner elongated tube 36 incorporates a reduced diameter section 46, which terminates with layer diameter ledge 47 of elongated tube 36. In addition, movement control means 48 is mounted about reduced diameter section 46 and is constructed for slidable engagement therealong. In this way, movement control means 48 is free to slide along reduced diameter section 46 between flow controlling valve 40 and ledge 47.

In the preferred embodiment, movement control means 48 comprises a central, substantially circular ring 49 and three, substantially equal length arms 50 extending radially outwardly from the outer surface of ring 49. Preferably, the length of each arm 50 is sufficient to extend arm 50 substantially to the inner diameter surface of slidable collar 22. In this way, flange 32 of collar 22 overlaps the terminating ends of arms 50 and is able to be moved into contacting engagement with the terminating ends of arm 50.

Inner elongated tube 36 also comprises, in the preferred embodiment, an elongated substantially flat metal plate member 53 securely mounted to the outer peripheral surface of elongated tube 36 by screw means 54. As is more fully detailed below, elongated, plate member 53 serves as a flow deflector for the liquid being transferred from the first storage container to the active reservoir.

Furthermore, towards the distal end of tube 36, a locking ring 56 is securely mounted in recess 55, with a washer 57 mounted adjacent thereto. Finally, coil spring 58 is mounted about the distal end of elongated tube 36, with one end of said coil spring 58 being engaged with washer 57, held in that position by locking ring 56.

The final major component incorporated in liquid filling/delivery system 20 of the present invention is elongated rod 60 which is mounted substantially along the central axis of liquid delivery/filling system 20. In the preferred construction, the overall length of rod 60 is greater than the overall length of inner elongated tube 36, while being less than the overall length of outer elongated tube 21. In addition, at the proximal end of rod 60, an air flow controlling valve 61 is securely affixed. Valve 61 incorporates a flow controlling, substantially conical shaped surface 62, the apex of which is securely affixed to the proximal end of rod 60. At the opposed end of conical surface 62, a sealing O-ring 63 is mounted.

As discussed above, flow controlling valve 40 comprises a substantially annular shape with a substantially centrally disposed portal 44 terminating with a ramped, substantially conical shaped surface 45. As shown in FIG. 2, flow controlling valve 61 is constructed for mating, flow controlling engagement with conical surface 45 of liquid flow controlling valve 40, with O-ring 63 of air valve 61 securely engaging with conical surface 45 when valve 61 is in its closed position. In this way, any flow of air through passageway 38 is prevented.

At its distal end, elongated rod 60 is preferably formed in a substantially hook shape to define an eyelet passageway 64. In addition, distal portion 28 of elongated outer tube 21 incorporates diametrically aligned through holes 65 through which pin 66 is securely mounted. As shown in FIG. 2, pin 66 passes thorugh eyelet 64 of shaft 60, thereby securing shaft 60 in a substantially fixed, immovable position. Furthermore, coil spring 58, which abuts ring 57 at one end thereof is maintained in position with pin 66 holding the opposed end thereof under compression.

As detailed above, spring 58 is maintained under compression between pin 66 and ring 57. Since ring 57 securely abuts centrally mounted ring 56, the force of spring 58 causes elongated tube 36 to be pushed away from pin 66. However, since the axial movement of tube 36 is restricted by air flow controlling valve 61 mounted at the distal end of shaft 60, the combination of these elements causes passageway 38 of elongated tube 36 to be normally maintained in the closed, sealed configuration with flow controlling valve 61 and mating surfaces 44 of flow controlling valve 40 being held in secure sealed abutting engagement by compression spring 58.

As is apparent from the foregoing detailed description, liquid delivery/filling system 20 of the present invention is normally maintained in its completely sealed configuration, with both air flow controlling valve 61 and liquid flow controlling valve 40 being held in their closed position, preventing any flow through the two independent flow channels associated therewith. However, as detailed below, when liquid delivery/filling system 20 of the present invention is activated, flow controlling valves 40 and 61 sequentially open, in a controllable manner, assuring that any unwanted liquid spillage or vapor pressure build up is not released in a manner that could lead to a dangerous situation.

Figure 4:
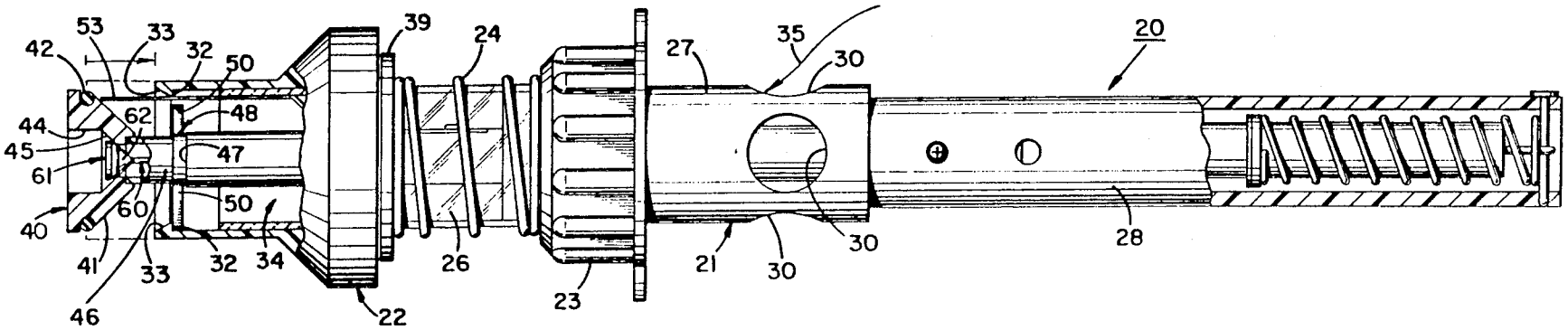
FIG. 4 is a side elevational view, partially in cross-section and partially broken away, of the fluid delivery and filling system of the present invention shown in its partially open position.
Figure 5:
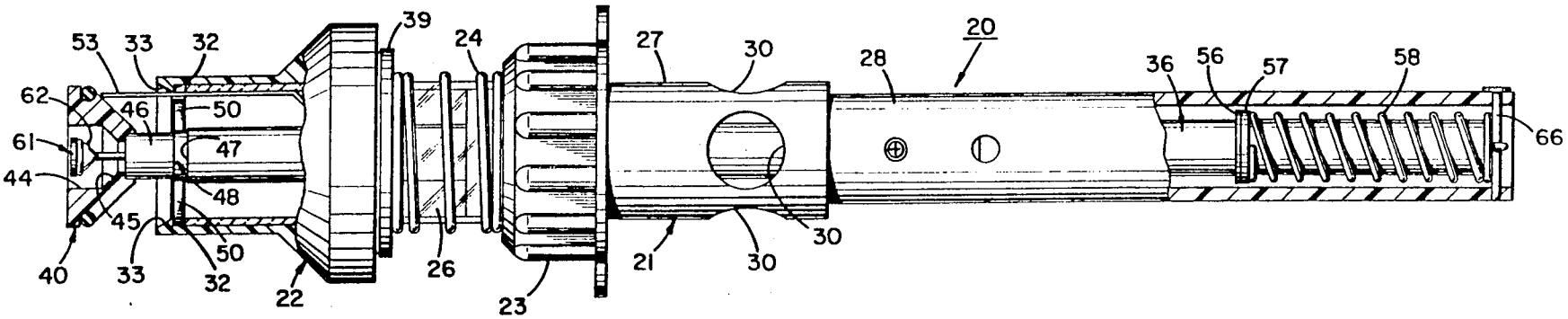
FIG. 5 is a side elevational view, partially in cross-section and partially broken away, of the fluid delivery/filling system of the present invention shown in its fully open position.

By referring to FIGS. 4 and 5, along with the following detailed disclosure, the sequential opening of flow paths 34 and 38 can best be understood. In addition, as is more fully detailed below, it is apparent that in normal use, cap 23 would be mounted to a liquid storage container with its associated O-ring 25 sealingly mounted with the container to prevent unwanted leakage. However, for purposes of clarity in the following explanation, liquid delivery/filling system 20 of the present invention is shown in FIGS. 4 and 5 without any associated storage container.

Before activating the liquid delivery/filling system 20 of the present invention by slidably moving collar 22, filling system 20 would be inserted into the active container or reservoir into which the liquid is to be transferred. This would be achieved by positioning funnel shaped collar 22 in the receiving aperture of the container or reservoir into which the liquid is to be transferred. For this reason, collar 22 is constructed with the overall funnel shape, with the outer diameter of the proximal end thereof being designed for easily fitting into the liquid receiving aperture formed in the normally used reservoirs.

In initially activating system 20 of the present invention, the user would slide collar 22 axially toward the distal end thereof, causing the compressive force of spring 24 to be increased.

As collar 22 is axially moved toward the distal end of system 20, ramped sealing surface 33 of collar 22 is removed from sealing engagement with O-ring 42 of flow controlling valve 40, thereby opening flow path 34 of outer tube 21. Once open, the liquid contained in the storage container is free to flow into portals 30 of central section 27 of elongated tube 21 through flow path 34 and out of system 20, passing between conical surface 41 of flow controlling valve 40 and ramp surface 33 of collar 22.

In addition, as collar 22 is axially moved distally, flange 32 of collar 22 captures arms 50 of movement control means 48. Regardless of the particular position movement control means 48 may be in movement control means 48 is captured by flange 32 and is moved axially along surface 46 until abutting ledge 47. As shown in FIG. 4, throughout this movement, inner elongated tube 36 remains in secure spring-biased engagement with air flow controlling valve 61, preventing any flow through path 38 associated therewith.

As a result, any high pressure, volatile vapors that may have built up in the storage container being dispensed is safely released directly into the container being filled, along with the liquid also stored in the container. Furthermore, during this initial actuation sequence, only the liquid flow path is open, thereby allowing only the liquid from the container to be dispensed with the high pressure volatile vapors that may have build up in the container merely causing added pressure on the liquid being dispensed, pushing the liquid more rapidly out of the container and into the reservoir to be filled. In this way, any dangerous result that might otherwise have occurred from the release of this volatile high pressure vapor is eliminated, by rendering the higher pressure harmless and, in fact, using the increased pressure to an advantage and more rapidly dispensing the liquid into the desired container.

Once the liquid flow channel or passageway 34 has been open, as detailed above, the continued sliding advance of collar 22 along proximal section 26 of elongated tube 21, with collar 22 advancing towards cap 23 in continued opposition to the compression force exerted by spring 24, the liquid delivery/filling system 20 of the present invention automatically causes the second passageway 38 to be opened.

As detailed above, when liquid carrying channel or passageway 34 is fully opened, movement control means 48 is captured between flange 32 of collar 22 and ledge 47 of inner elongated tube 36. As collar 22 is moved further towards the distal end of the delivery/-filling system 20, the additional movement of collar 22 causes inner, elongated tube 36 to be axially moved in its entirety toward the distal end of system 20, until the distal end of elongated tube 36 comes into direct contact with pin 66, and arms 50 of movement control means 48 is sandwiched between flange 32 of collar 22 and the proximal edge of transparent section 26 of tube 21. As clearly shown in FIG. 5, the axial movement of elongated tube 36 into abutting contact with pin 66 causes spring 58 to be further compressed between pin 66 and ring 57.

Furthermore, the axial sliding movement of elongated tube 36 also causes the conical shaped surface 45 of liquid flow controlling valve 40 to become disengaged from sealing contact with conical surface 62 of air flow controlling valve 61. As a result, air flow passageway 38 of elongated tube 36 is open, allowing the air contained in the reservoir being filled to be automatically channeled through passageway 38, while the liquid entering the reservoir freely flows through passageway 34 of outer elongated tube 21.

As is readily apparent from the preceding detailed disclosure, the liquid delivery/filling system 20 of the present invention automatically achieves sequential, controlled actuation of a liquid flow path and a separate, independent air flow path in a precise trouble-free controlled manner.

By providing, the sequential, controlled actuation of a liquid flow channel or passagway and a separate, independent air flow channel or passageway, a liquid delivery/filling system is attained which eliminates the prior art problems and difficulties encountered in transferring volatile liquids from one container to an active reservoir. By employing the delivery-filling system of the present invention, all flow of the volatile liquid is prevented until specifically initiated by the user, with any pressure built up in the storage container being used to the system's advantage free of any harm or unwanted spillage or contact with hot surfaces.

Furthermore, once the volatile liquid flow has been initiated, the air flow passageway is automatically opened to allow the liquid entering the active reservoir to easily displace the air contained in the reservoir, while the air is safely channeled into the storage container in a completely separate flow channel which delivers the air to the area of the container which is furthestmost from the exit portal for the volatile liquid. This construction is most clearly shown in FIG. 6, wherein the liquid delivery/filling sytem 20 of the present invention is shown in one typical system in actual use.

Figure 6:
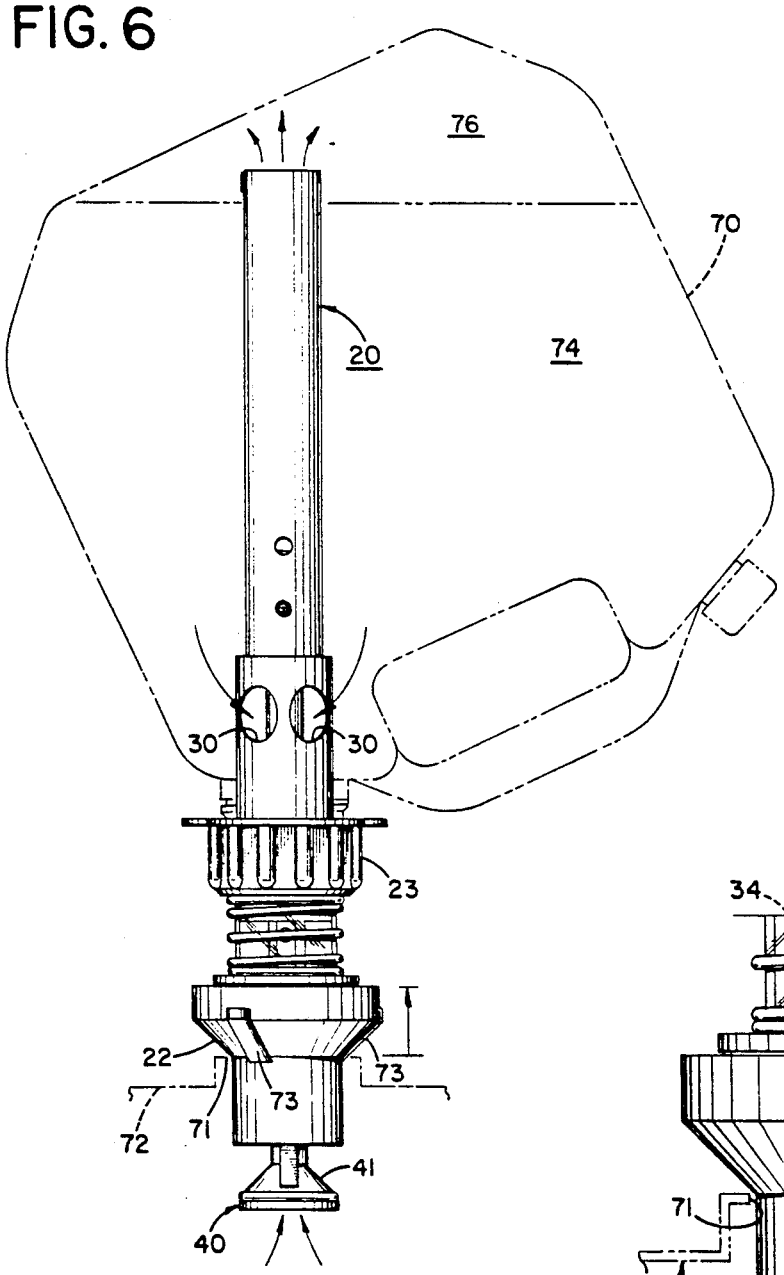
FIG. 6 is a diagrammatic view, partially in cross-section and partially broken away showing the liquid delivery/filling system of the present invention in use transferring fluid from one reservoir into another.

As depicted in FIG. 6, liquid delivery/filling system 20 of the present invention is securely affixed to a conventional liquid storage tank 70, with cap 23 threadedly engaged to container 70 in sealing contact therewith, preventing any unwanted leakage. Furthermore, funnel shaped collar 22 is inserted into the open mouth 71 of reservoir 72 into which the liquid 74 in storage container 70 is to be transferred. As clearly shown in FIG. 6, liquid 74 is easily emptied from container 70, since portals 30 are positioned near the mouth of container 70. In this way, all the liquid 74 stored in container 70 can be removed therefrom and transferred to reservoir 72.

In the embodiment shown in FIG. 6, funnel-shaped collar 22 incorporates a plurality of optional ribs 73, extending from the outer conical funnel-shaped surface thereof. By employing ribs 73, the funnel-shaped surface of collar 72 is prevented from forming a complete seal with mouth 71 of reservoir 72. Instead, air gaps are established between mouth 71 and the funnel-shaped surface of collar 22 adjacent the plurality of ribs 73. As a result, by using this embodiment, any vapor pressure build-up within reservoir 72 is safely dissipated through the gaps formed between mouth 71 and the funnel-shaped surface of collar 22, without causing any adverse effects.

In addition, the distal end of system 20 is clearly shown to extend to the furthestmost location of container 70. In this way, the distal end of system 20 extends into the region above the liquid level, in order to allow the delivery of the air displaced from reservoir 72 into an air zone 76 above liquid level 74 of container 70. In this way, the displaced air is not forced to bubble through the liquid being delivered which typically causes irregular flow patterns for the liquid as well as potential spilling or uncontrolled liquid flow. By employing the present invention, these adverse flow patterns are completely eliminated and a free flowing safe flow path is achieved for liquid 74 as it is transferred from container 70 into reservoir 72.

The free flow of the liquid 74 from container 70 continues in a manner described above, with the displaced air passing around air control valve 61 through passageway 38 of inner elongated tube 36 until reservoir 72 is almost completely full. From the time the liquid begins flowing until container 72 is almost completely full, liquid 74 flows through passageway 34 of elongated tube 21 with the liquid flowing out of collar 22 between the inner surface thereof and the outer conical surface 41 of liquid flow control valve 40.

This free, rapid, controlled flow of liquid 74 with the controlled independent transferral of the displaced air through passageway 38 of inner elongated tube 36 continues until the liquid level in container 72 reaches the proximal edge of liquid flow control valve 40. At this time, air can no longer freely flow through elongated tube 36, since the liquid level in reservoir 72 has effectively sealed the opening to passageway 38. However, in order to allow all of the liquid in container 70 to be added to reservoir 72, the liquid delivery/filling system 20 of the present invention incorporates deflector 53.

Figure 7:
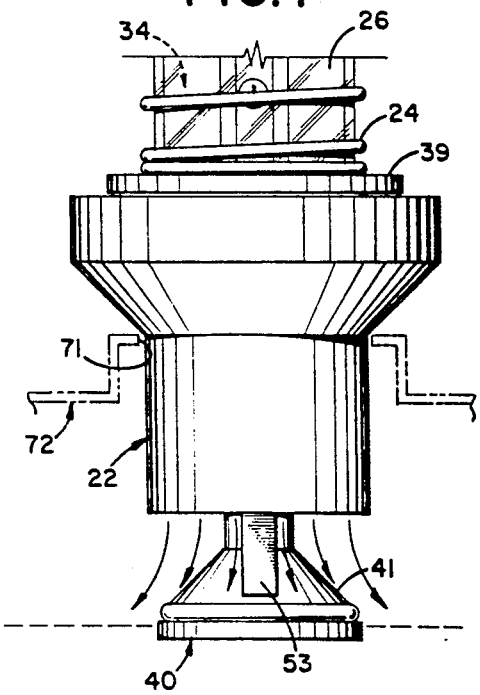
FIG. 7 is a side elevational view of the liquid delivery/filling system of the present invention shown in operation as the tank being filled nears completion.

As shown in FIG. 7, the liquid freely flows through collar 22, between the inner surface thereof and the conical outer surface 41 of liquid flow control valve 40 even when air can no longer flow through passageway 38. Without deflector 53, a complete conical shaped flow path would be established and the displaced air could not escape. However, with deflector 53, the liquid is prevented from completing a full conical shape. Instead, an open path is formed by deflector 53. As a result, air which is incapable of now passing through passageway 38 of tube 36 can pass in the reverse direction, through passageway 34 of tube 21, due to the opening provided in the conical flow path by deflector 53.

In the preferred embodiment, proximal section 26 of elongated outer tube 21 comprises transparent material. In this way, the user of system 20 can easily see the air exiting through passageway 34 by the bubbling effect visual through proximal section 26. As a result, the operator knows that reservoir 72 is substantially filled and flow will soon cease completely or, if desired, can be manually terminated by removing system 20 from reservoir 72.

It has also been found that by eliminating deflector 53, the unbroken, continuous, conical shaped flow pattern achieved by the liquid delivery/filling system 20 of the present invention operates efficiently to fill reservoir 72 up to the leading edge of valve 40. However, when the air can no longer flow through passageway 38 of inner elongated tube 36, flow automatically ceases. As a result, the preferred embodiment of system 20 incorporates deflector 53. However, if desired, a delivery system can be constructed without deflector 53.

With deflector 53 in place, free flow of liquid 74 from container 70 continues until either all of the liquid has been removed from container 70 or, until, the liquid 74 in reservoir 72 has reached the proximal edge of collar 22. If the liquid 74 fills up to the proximal edge of collar 22, further flow of the liquid will be prevented. At this time, liquid delivery/filling system 20 would be removed from reservoir 72 and the vehicle being filled can be returned to operation.

Upon removal of liquid delivery/filling system 20 from its fully open, free flowing position, as depicted in FIG. 5, the system is automatically returned to the completely sealed configuration, shown in FIG. 2. As is apparent from the preceding detailed disclosure, coil spring 58 forces inner elongated tube 36 towards the proximal end of system 20, bringing air flow controlling valve 61 into sealing engagement with conical surface 45 of liquid flow controlling valve 40.

In addition, coil spring 24 forces collar 22 forward, toward the proximal end of system 20, bringing ramped surface 33 of collar 22 into abutting, sealing engagement with O-ring 42 and conical surface 41 of liquid flow control valve 40. In this way, system 20 is automatically returned to its sealed configuration, with both independent flow channels 34 and 38 completely closed, with system 20 remaining in this configuration until manually activated for future use.

In FIGS. 8, 9, 11 and 12, the preferred embodiment of integrated, interlocking, mating/liquid transfer assembly 100 of the present invention is shown. In this embodiment, liquid transfer assembly 100 incorporates a housing 101 connecting one end thereof to a supply tube 102. In order to control the flow of the toxic chemical liquid being supplied, a valve assembly 103 is preferably mounted between supply tube 102 and housing 101.

Figure 9:
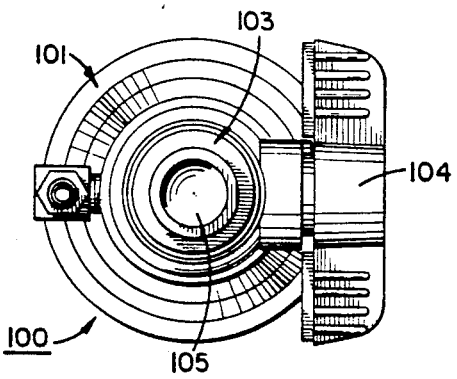
FIG. 9 is a top plan view of the liquid transfer assembly of FIG. 8.

In this preferred embodiment, valve assembly 103 comprises a conventional pivotal ball 105 which incorporates a passageway therethrough. Ball 105 is constructed for rotational movement about its central axis, within valve assembly 103, with the movement of ball 105 being controlled by handle 104. Typically, handle 104 rotates through an arc of about 90°, controllably pivoting ball 105 between its two alternate positions, a closed position, as shown in FIG. 9, wherein flow through tube 102 to housing 101 is prevented and an open position, wherein the passageway is aligned with tube 102 and housing 101 to allow the liquid to flow therethrough.

Housing 101 of interlocking, mating/liquid transfer assembly 100 incorporates a central body portion 108 and a peripherally surrounding, depending wall portion 109 extending from body portion 108 in a direction opposite from valve assembly 103. Body portion 108 is connected to one end of valve assembly 103 and, as is more fully detailed below, incorporates, in the preferred embodiment, a separate, flow-control means to prevent the passage of the toxic chemical liquid through liquid transfer assembly 100 when not desired. In addition, fitting 106 is threadedly mounted in body portion 108, providing a venting passageway between the interior and exterior of body portion 108.

Figure 8:
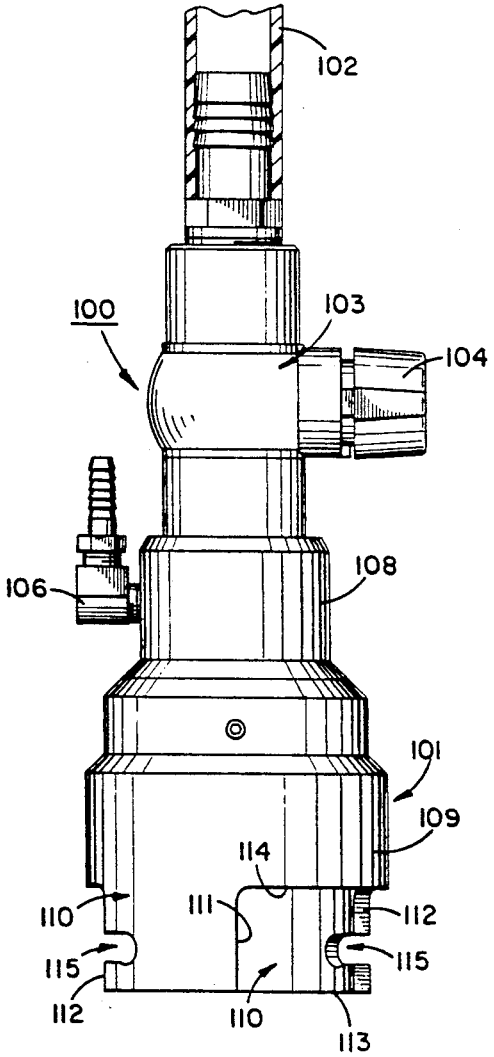
FIG. 8 is a side elevational view showing the liquid transfer assembly of the present invention.
Figure 11:
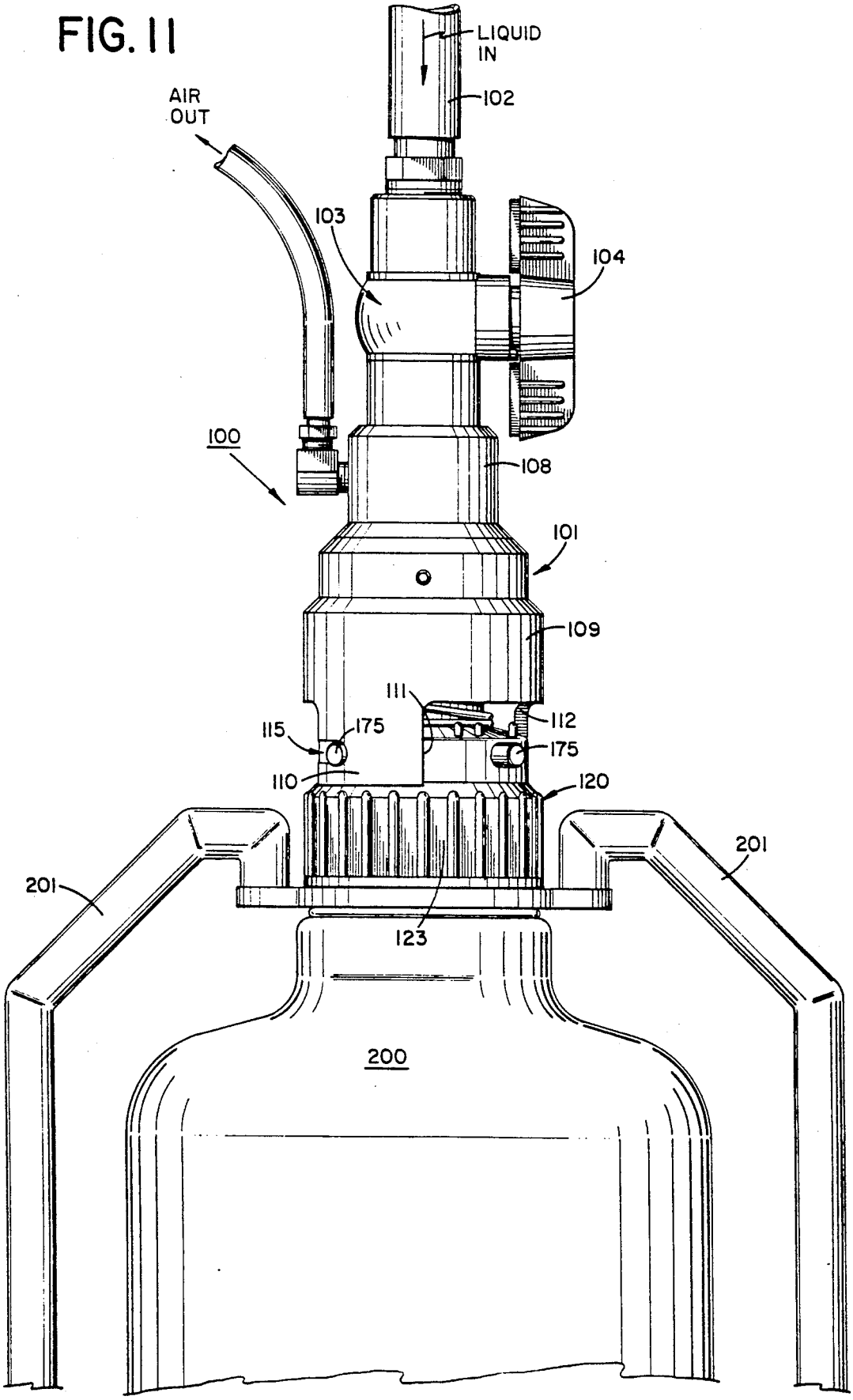
FIG. 11 is a side elevation view, partially broken away, depicting the liquid transfer assembly of the present invention in locked engagement with the liquid delivery/filling system of this invention, with the liquid delivery/filling system securely mounted to a reuseable container.

As shown in FIGS. 8 and 11, wall portion 109 of housing 101 comprises a substantially hollow cylindrical shape and incorporates two flange portions 110, 110 each extended from lower edge 114 of wall portion 109 and comprising vertical side edges 111 and 112, and bottom edge 113. In addition, both vertical side edges 112 incorporate a slot 115 which extends substantially perpendicularly to side edge 112 inwardly therefrom, substantially parallel to lower edge 113.

Figure 10:
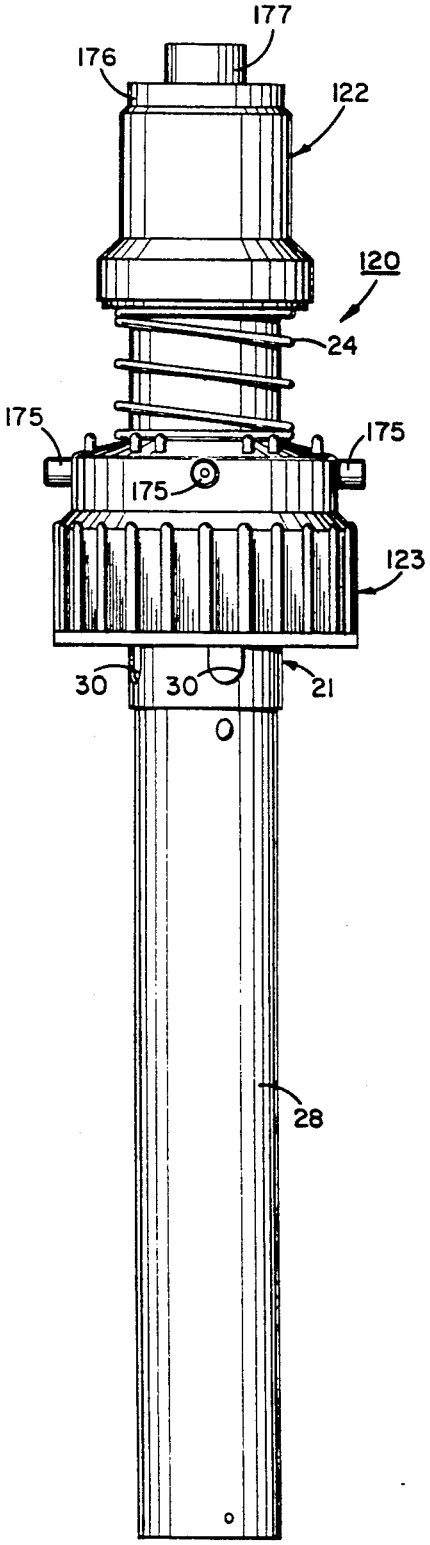
FIG. 10 is a side elevation view showing a slightly modified embodiment of the liquid delivery/filling system of this invention.

In FIG. 10, the liquid delivery/filling system of this invention is depicted in a slightly altered embodiment. In this embodiment, liquid delivery/filling system 120 is constructed substantially identically to the construction detailed above and shown in FIGS. 1–7. In fact, if desired, the embodiments detailed above can be employed directly with integrated mating liquid transfer assembly 100 of this invention. However, in order to provide the desired interlocking mating interengagement of liquid transfer assembly 100 with the liquid delivery/filling system of this invention, the embodiment shown in FIG. 10 is preferred.

As shown in FIG. 10, liquid delivery/filling system 120 incorporates a plurality of radially extending pins 175 which extend from sealing cap 123. In addition, slidable collar 122 is preferably constructed in the manner depicted in FIG. 10, incorporating an extending flange 176 which peripherally surrounds and encloses liquid flow controlling valve 40. In addition, liquid flow controlling valve 40 incorporates an axially extending, upstanding hollow cylindrically-shaped wall portion 177. Other than these minor modifications, liquid delivery/filling system 120 is otherwise constructed substantially identically to liquid delivery/filling system 20 detailed above and shown in FIGS. 1–7.

In FIG. 11, liquid delivery/filling system 120 is shown securely affixed to a typical toxic chemical liquid storage container 200 which, in this embodiment, incorporates side handles 201 in order to more easily lift and maneuver storage container 200. As detailed above, in the preferred embodiment, liquid delivery/filling system 120 is preferably permanently affixed to container 200 in order to prevent its removal by the user. In this way, assurance is provided that container 200 is reuseably employable for transferring the concentrated chemical liquid contained therein to the active reservoir for dilution, and not disposed of with chemical residue contained therein after a single use.

Figure 12:
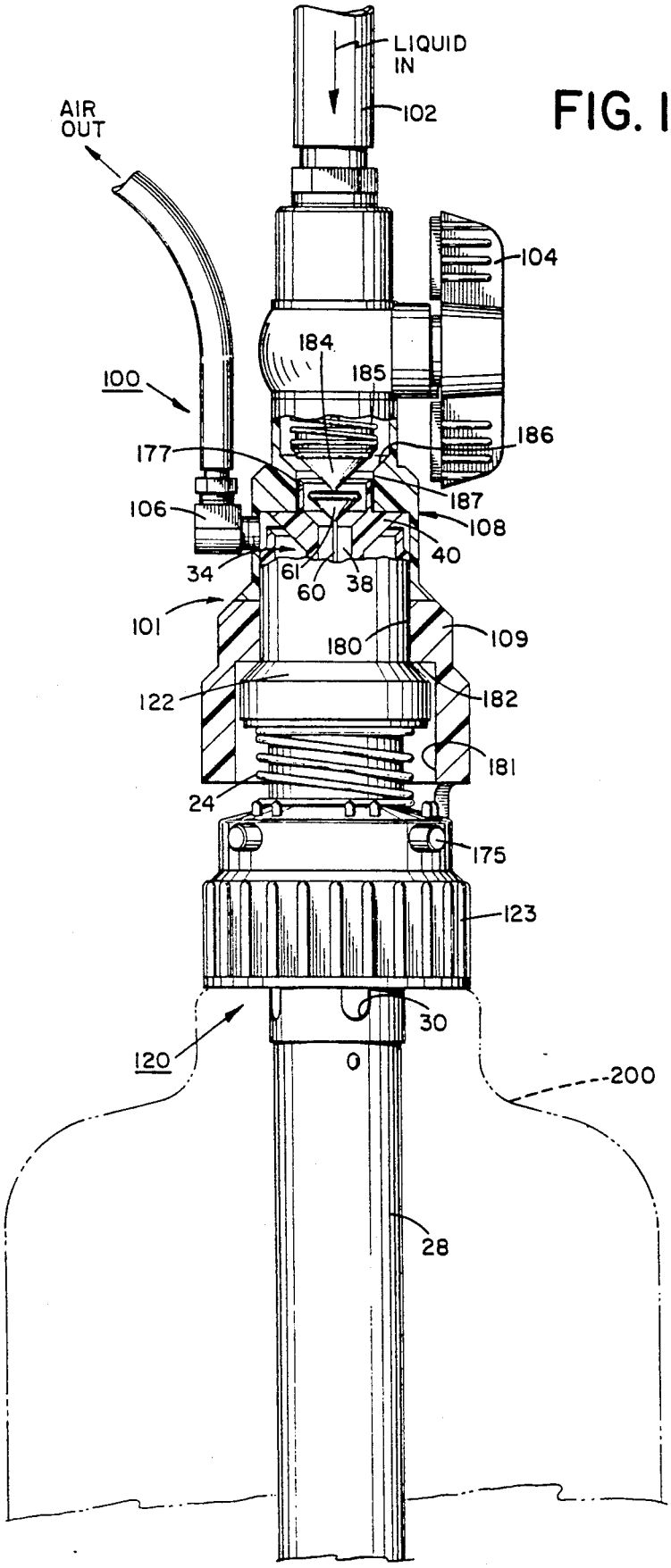
FIG. 12 is a side elevation view, partially broken away, similar to the view of FIG. 11, with the liquid transfer assembly of the present invention depicted securely affixed to the liquid delivery/filling system of this invention.

As shown in FIGS. 11 and 12, integrated interlocking mating liquid transfer assembly 100 is depicted securely mounted to liquid delivery/filling system 120 to enable container 200 to be refilled for subsequent use. Mating liquid transfer assembly 100 is quickly and easily securely mounted in locked interengagement with liquid delivery/filling system 120 by mounting housing 101 about slidable collar 122 and telescopically advancing transfer assembly 100 onto liquid delivery/filling system 120, causing collar 122 to move axially downward into its open position.

Once liquid delivery/filling system 120 is in its open position, system 120 is locked in this open position by rotating assembly 100 about its central axis into locked engagement with liquid delivery/filling system 120. When rotated about its central axis, slots 115 formed in flange 110 of housing 101 advance into locked interengagement with radially extending pins 175 of sealing cap 123. In this way, liquid transfer assembly 100 is maintained in locked interengagement with liquid delivery/filling system 120 until transfer assembly 100 is purposefully rotated about its central axis to disengage assembly 100 from delivery/filling system 120.

By referring to FIG. 12, along with the following detailed disclosure, the safe, secure, controlled, spill-free liquid delivery flow paths established by the locked interengagement of transfer assembly 100 and liquid delivery/filling system 120 can best be understood. As clearly apparent from FIG. 12, the overall construction and shape of stepped, hollow, cylindrical depending wall portion 109 of housing 101 is dictated by the outer surface configuration of slidable collar 122 of liquid delivery/filling system 120. Consequently, the shapes of these members may be altered without departing from the scope of this invention. However, regardless of the changes made, cooperation therebetween must be maintained.

As shown in FIG. 12, wall portion 109 is constructed with inside walls 180 and 181 having two separate and distinct diameters, with the juncture therebetween being defined by collar engaging ledge 182. In this construction, the diameter of wall 180 is defined by the overall outer diameter of slidable collar 122, while the overall diameter of second wall 181 is constructed to be greater than the overall diameter of the rear enlarged flange portion of collar 122. In addition, ledge 182 is positioned for contacting slidable collar 122 precisely at the juncture between the dual diameter zones, so as to engage and force slidable collar 122 to move along its central axis, compressing spring 24.

By incorporating collar engaging ledge 182 as a portion of wall 109 of housing 101, assurance is provided that the telescopic mounting engagement of housing 101 onto liquid delivery/filling system 120 automatically causes slidable collar 122 to be moved from its closed position to its open position, thereby establishing the opening of the desired flow paths. In addition, as detailed above, housing 101 is constructed to assure that liquid delivery/filling system 120 is locked in the desired open configuration by the engagement of elongated slots 115 with radially extending pins 175. Consequently, whenever housing 101 of liquid transfer assembly 100 is telescopically mounted to liquid delivery/filling system 120 in a manner which enables radially extending pins 175 to be positioned in locked engagement within slots 115 of wall portion 109, assurance is provided that liquid delivery/filling system 120 is secured and maintained in its open position, with both of its liquid air flow paths fully useable.

In order to assure trouble-free transferral of the concentrated toxic liquid from the primary supply to container or reservoir 200, central portion 108 of housing 101 of liquid transfer assembly 100 incorporates valve 184. Normally, valve 184 is maintained in biased interengagement with conical shaped wall 186 by spring means 185. In this way, whenever liquid transfer assembly 100 is disconnected from a delivery/filling system 120, valve 184 is maintained in secure, biased, flow-stopping engagement with wall 186. As a result, regardless of the position of handle 104 and the ball valve to which it is connected, flow of the toxic liquid through liquid transfer assembly 100 of this invention is automatically prevented, whenever assembly 100 is disconnected from engagement with the delivery/filling system.

In addition, in the preferred embodiment, sloping wall 186 terminates at one end thereof with an inside, upstanding, substantially circular-shaped portal defining wall 187 which is positioned directly adjacent valve 184, forming the portal entry thereto. As clearly shown in FIG. 12, portal defining wall 187 comprises a diameter slightly greater than the diameter of upstanding flange 177 of slidable collar 122. In this way, the precisely desired telescopically aligned interengaged relationship of liquid delivery/filling system 120 and liquid transfer assembly 100 is assured and mating locked interengagement in the precisely desired position is effortlessly attained.

As shown in FIG. 12, when liquid delivery/filling system 120 is matingly lockingly interengaged with liquid transfer assembly 100, valve 184 of liquid transfer assembly 100 is forced out of engagement with sloping wall 186, thereby assuring that flow through valve 184 is provided. By properly telescopically matingly engaging liquid delivery/filling assembly 120 with liquid transfer assembly 100, valve 61 mounted at the terminating end of rod 60 of liquid delivery/filling assembly 120 is brought into abutting contacting engagement with valve 184 of liquid transfer assembly 100, causing valve 184 to be forced out of engagement with sloping wall 186, thereby opening the desired flow path.

In addition, the mating telescopic engagement of upstanding flange 177 in wall 187 assures that valve 61 is properly positioned for contacting valve 184 and forcing valve 184 into its open position. In addition, once liquid delivery/filling assembly 120 is locked in mating engagement with liquid transfer assembly 100, valve 184 is maintained in the open configuration until liquid transfer assembly 100 is disengaged and removed therefrom.

Once liquid transfer assembly 100 and liquid delivery/filling system 120 are positioned in locked interengagement with each other, as detailed above, and handle 104 of ball valve section 103 is rotated to open ball valve 103, the toxic liquid from the supply tank or other storage medium is able to flow through tubing 102 and valve assembly 103 into liquid transfer assembly 100. As detailed above, with valve 184 in the open position, the liquid is capable of flowing past valve 184 and valve 61 directly into passageway 38 of liquid delivery/filling system 120. As detailed above, passageway 38 extends through the entire length of liquid delivery/filling assembly 120, thereby enabling the liquid flow to pass completely through passageway 38 directly into storage container 200.

As container 200 begins to be filled with the desired toxic chemical liquid, the air originally within container 200 is displaced and is forced to exit container 200. As shown in FIG. 12, the exiting air is easily removed from container 200 by passing through portals 30 of system 120 which connect directly to passageway 34. The air flow continues through passageway 34, enabling the air from container 200 to exit between valve 40 and slidable collar 122.

Once the air from container 200 has exited completely through passageway 34 and liquid delivery/filling system 120, air enters the inside chamber defined by wall 180 of central portion 108 of liquid transfer assembly 100. However, as clearly shown in FIG. 12, the exiting air flow is precisely in the zone where fitting 106 has been threadedly engaged in the wall of central section 108. As a result, the air passing through passageway 34 of liquid delivery/filling assembly 120 merely exits through fitting 106 and its associated tubing to the desired vent location.

By employing this construction, any toxic chemical liquid is capable of being safely and efficiently delivered directly into storage container 200 with any chance of spilling or leaking of toxic liquid being completely eliminated. Furthermore, complete control of the flow of the liquid, as well as removal of the air from container 200, is efficiently provided.

As is apparent from this detailed disclosure, the passageways of liquid delivery/filling assembly 120 are employed in reverse to the use of these flow channels provided during the transfer of liquid from storage container 200 to the desired active reservoir. However, regardless of the use of the liquid flow path as an air flow path and the use of the air flow path as a liquid flow path, the safe, efficient, transfer of the desired toxic liquid into container 200 is efficiently attained.

Once container 200 has been completely filled, as would be evident by external observation of container 200, as well as by suitable markings preferably positioned thereon, the flow of the liquid would be terminated by rotating handle 104 to prevent any further flow of the liquid into housing 101 of liquid transfer assembly 100. Once the flow has ceased, liquid transfer assembly 100 is quickly and easily removed from liquid delivery/filling system 120 by rotating liquid transfer assembly 100 out of locked interengagement with pins 175. Once disengaged, liquid transfer assembly 100 is easily lifted and removed therefrom. Once removed, slidable collar 122 is automatically forced by spring means 24 into its closed position, thereby enabling refilled container 200 to be taken and re-used by delivering the desired toxic chemical liquid to the useable tank for dilution and application to the desired site.

In FIGS. 14–25, an alternate preferred embodiment of the integrated, cooperating, interlocking, liquid flow controlling system of the present invention is fully and completely detailed. In this embodiment, integrated, cooperating, liquid-flow controlling system 210 incorporates liquid transfer assembly 211 and liquid delivery/filling assembly 212.

As is fully detailed below, in this embodiment, integrated, cooperating, liquid-flow controlling system 210 provides a liquid transfer assembly 211 which is incapable of being activated unless telescopically mounted in the precisely desired securely engaged relationship with liquid delivery/filling assembly 212. In addition, liquid transfer assembly 211 must be securely interlocked with liquid delivery/filling assembly 212 in the precisely desired position in order to enable the transfer of the desired liquid.

Furthermore, once mounted in interlocked interengagement, liquid transfer assembly 211 is incapable of being disconnected from liquid delivery/filling assembly 212 while liquid is flowing through the system. Only after the liquid flow has been stopped and positive disconnection steps taken, can liquid transfer assembly 211 be removed from liquid delivery/filling assembly 212.

In this alternate preferred embodiment, liquid delivery/filling assembly 212 incorporates an interlocked feature which prevents the unwanted opening of the liquid delivery/filling assembly when not desired. In this way, assurance is provided that the liquid being transferred into container 200, as well as dispensed from container 200 into a desired reservoir, is not accidentally spilled or released in any unwanted area, through accidental opening of liquid delivery/filling assembly 212.

Figure 13:
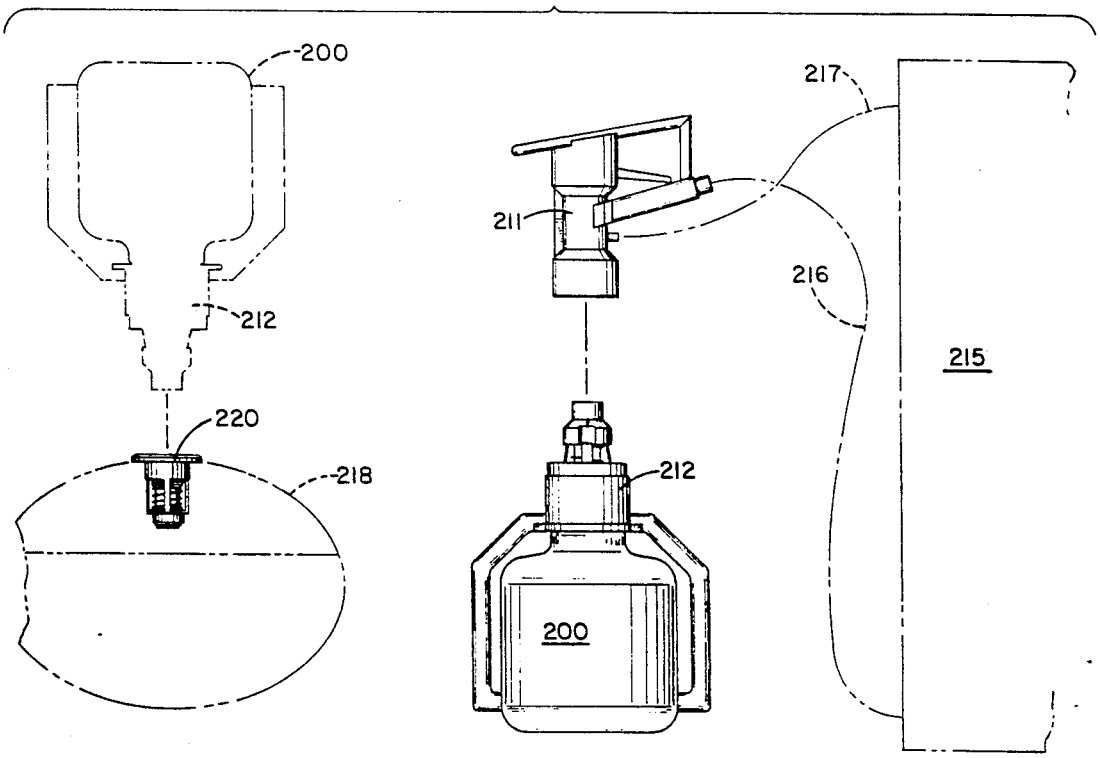
FIG. 13 is a schematic view depicting the closed loop, fully controlled, spill free, gravity free, liquid distribution system attained by employing the integrated, cooperating, liquid flow controlling system of this invention.

Before detailing the construction and operation of this embodiment of integrated, cooperating, liquid flow controlling system 210, reference should be made to FIG. 13, wherein one preferred manner of use of this invention is depicted and the importance of achieving a completely trouble-free controlled dispensing system for toxic chemicals is evident.

As discussed above, the distribution of many liquid products has resulted in spillage of undesirable or toxic materials into our environment, causing potential hazards or damage to the environment, including people and animal life living in the area. In view of the increasing potential hazard that has existed from these unwanted chemical spillages, attempts have been made to develop a system which would eliminate this hazard. As depicted in FIG. 13, the present invention eliminates all of the problems that have existed in the prior art and provides a substantially completely full-proof, integrated, cooperating liquid flow controlling system which assures that the liquid being transferred at each and every step in the transferral process is executed in a virtually spill-free, error-free, controlled manner.

Although many alternate chemical or liquid product distribution systems exist wherein the integrated, cooperating, liquid flow controlling system of the present invention can be employed, FIG. 13 depicts the use of the flow controlling system of the present invention in the controlled, spill-free distribution of chemicals typically employed in agricultural or farming environments. As detailed above, such chemicals are often employed for promoting the growth of the agricultural products and/or controlling the attack of such products by insects or disease.

As shown in FIG. 13, holding tank 215 represents a large concentrated chemical holding tank located at a distribution center at which individuals desiring to obtain the chemical would come with smaller, portable containers 200. As has been detailed above, liquid delivery/filling assembly 212 is preferably securely affixed to container 200 in order to prevent its unauthorized removal. Consequently, by employing this distribution system, the farmer or customer requiring or desiring to employ the particular chemicals could only have container 200 filled at an authorized distribution center wherein mating, integrated, cooperating liquid transfer assembly 211 is available for telescopic, secure, locked, mounted interengagement with liquid delivery/filling assembly 212, in order to fill or refill container 200 with the desired chemical.

As diagrammatically depicted in FIG. 13, hose or conduit 216 is employed to transfer the desired chemical or liquid from holding tank 215 to liquid transfer assembly 211, while conduit 217 is employed to transfer the displaced air from container 200 into holding tank 215, where it can be safely handled, depending upon its environmental impact.

Once container 200 has been filled with the desired concentrated chemical, or liquid, the user is ready to employ the chemical in the proper manner. In order to assure that proper, spill-free use of the chemical is attained, liquid delivery/filling assembly 212 has the construction detailed below and cooperates, in this preferred embodiment, with a supply tank adaptor 220.

As is more fully detailed below, supply tank adaptor 220 is preferably mounted in supply tank 218 into which the user would place a measured amount of the chemical or liquid from container 200 and then dilute the chemical or liquid for application to the particular site in the authorized manner. However, by employing the specially designed filler unit 220, assurance is provided that flow controlling system 210 of this invention is operated in the precisely desired manner, with all chemical transfer being completely controlled and spill-free.

Once the chemical or toxic liquid from container 200 has been placed in supply tank 218 and diluted in the proper manner, the user is ready to apply the precisely desired, environmentally safe chemical in the authorized manner. In addition, once all of the chemical contained in container 200 has been used in its entirety, the user merely returns to the distribution outlet to have container 200 refilled in the manner detailed above.

In this way, a completely closed loop, environmentally safe distribution system is attained where each and every chemical transferral step is achieved in a manner which assures a spill-free, environmentally safe chemical transfer. In this way, the hazard or potential hazards which have previously existed are eliminated. Furthermore, by employing container 200 with sealed liquid delivery/filling assembly 212 mounted thereto, with container 200 purposefully constructed for re-use as the only vehicle by which the desired chemicals can be obtained, unwanted discarding of empty containers is eliminated and further environmental pollution is avoided.

Consequently, it is readily apparent that the distribution system of the present invention, with the integrated, cooperating liquid flow controlling system detailed herein eliminates all of the prior art environmental hazards which have previously existed. In addition, the present invention provides an environmentally safe system in which any chemical or liquid having a potentially environmental hazard associated therewith can be safely distributed and used, without incurring any negative impact on the environment.

By referring to FIGS. 14 and 16–22, along with the following detailed disclosure, the construction and operation of this alternate preferred embodiment of liquid transfer assembly 211 can best be understood. In this construction, liquid transfer assembly 211 comprises a housing 225 which incorporates two separate and distinct flow channels 226 and 227 formed therewith. Preferably, flow channel 226 comprises an enlarged flow channel extending from housing 225 which is positioned for easy, secure, mating engagement with the supply conduit, which is connected to the supply tank, as detailed above. Flow channel 227 is preferably substantially smaller and is employed as the air passage conduit connectable with the air line, as detailed above.

Figure 14:
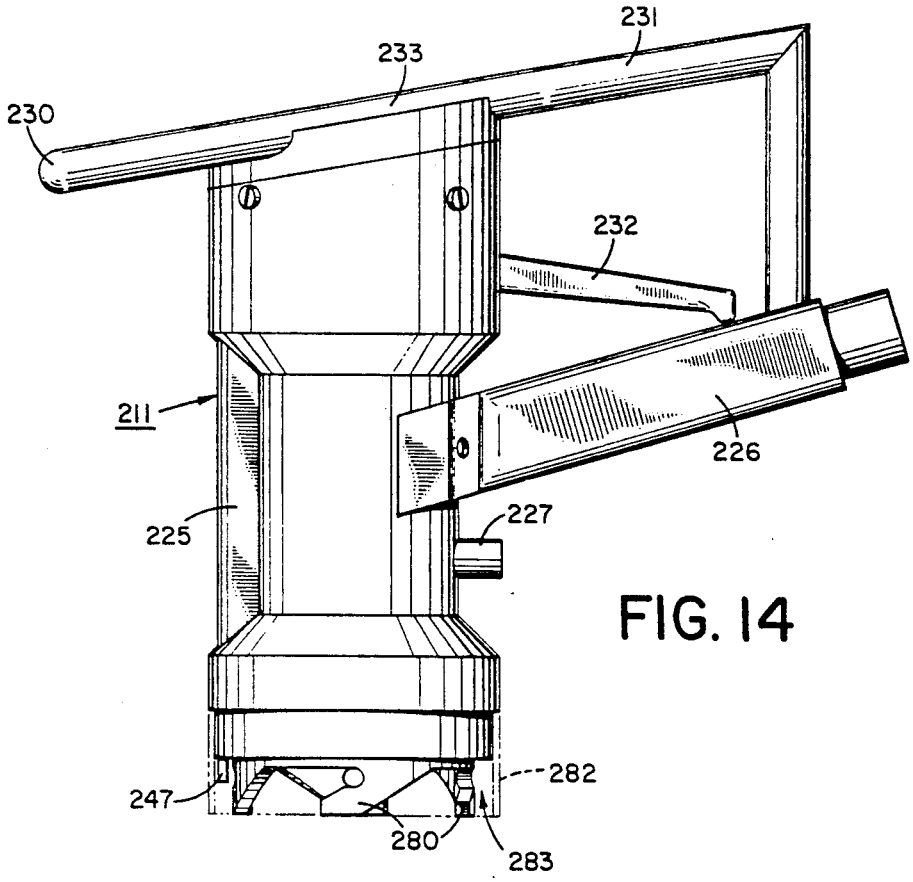
FIG. 14 is a side elevation view of an alternate preferred embodiment of the liquid transfer assembly of this invention.
Figure 15:
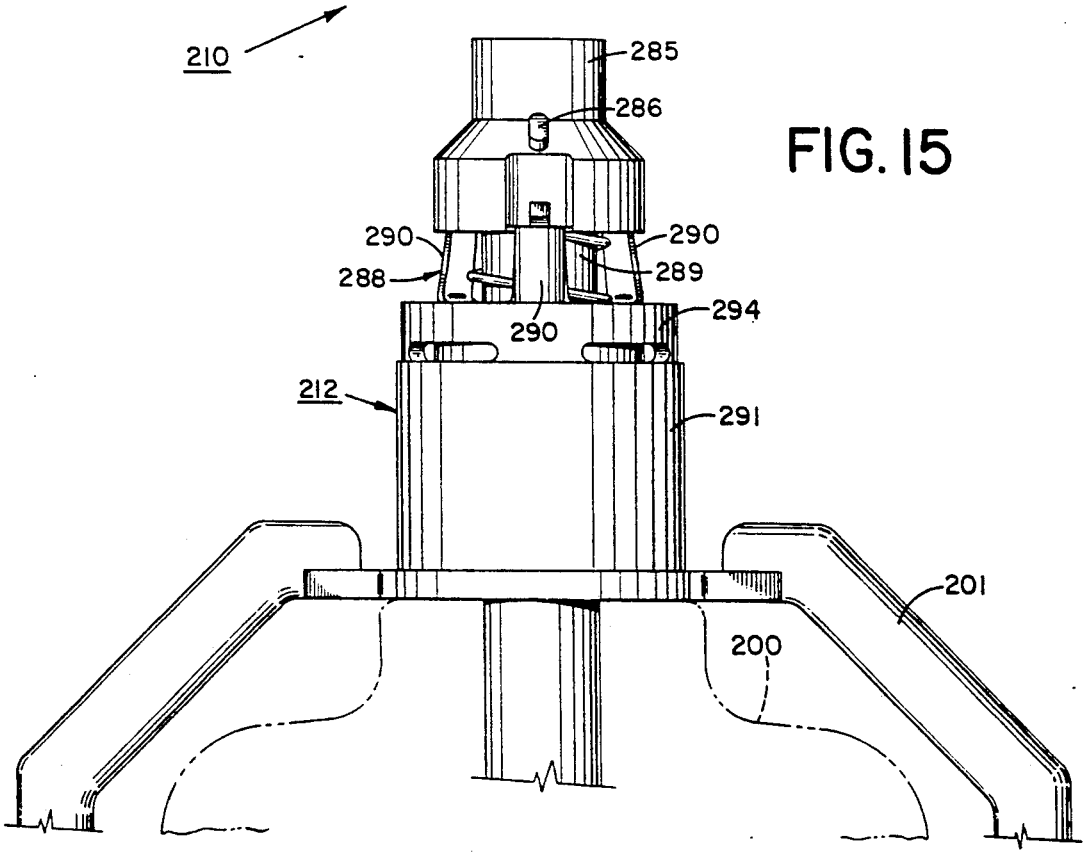
FIG. 15 is a side elevation view, partially broken away, depicting an alternate preferred embodiment of the liquid delivery/filling assembly of the present invention securely affixed to a container.

As best seen in FIGS. 14 and 16, liquid transfer assembly 211 incorporates a readily accessible, easily employable handle portion 230, preferably extending from top 233 of housing 225. In addition, the support arm 231 also extends from top 233 of housing 225, preferably positioned diametrically opposed to handle portion 230 and radially extending outwardly from housing 225. In addition, in the preferred construction, support arm 231 comprises a generally "L-shaped" configuration.

Liquid transfer assembly 211 also comprises a movable, flow controlling lever 232 which, as is detailed below, is employed to initiate and terminate the flow of the liquid through transfer assembly 211. In the preferred configuration, support arm 231, flow controlling lever 232, and enlarged liquid flow channel 226 are vertically aligned in substantially the same axial plane, radially extending from housing 225. In this way, ease of movement of lever 232 and control over the flow of the chemical through liquid transfer assembly 211 is assured, and any accidental movement of flow control lever 232 is substantially eliminated.

By employing this construction, the user is easily able to move liquid transfer assembly 211 by grasping handle portion 230 in one hand and support arm 231 in the other hand. In this way, complete movement and control of liquid transfer assembly 211 is assured. Furthermore, by merely reaching downwardly, the operator is able to grasp flow controlling lever 232 and activate lever 232 whenever the flow preventing multi-functional interlocking system has been properly activated.

One of the principal achievements attained by liquid transfer assembly 211 of this invention is the achievement of a flow controlling, interlock system which requires liquid transfer assembly 211 to be securely positioned in mating, interlocked engagement with liquid delivery/filling assembly 212 in the precisely desired orientation, before flow controlling lever 232 is able to be lifted to initiate the flow of the chemical into the desired container. Consequently, unwanted accidental spillage of the chemical is virtually eliminated.

In this way, liquid transfer assembly 211 achieves a complete, full-proof liquid flow controlling system wherein unwanted and undesirable spillage of the liquid is avoided. In addition, any possibility that the system could be used by unauthorized individuals is eliminated. As a result, complete, controlled transferral of toxic liquids or chemicals is attained.

Figure 17:
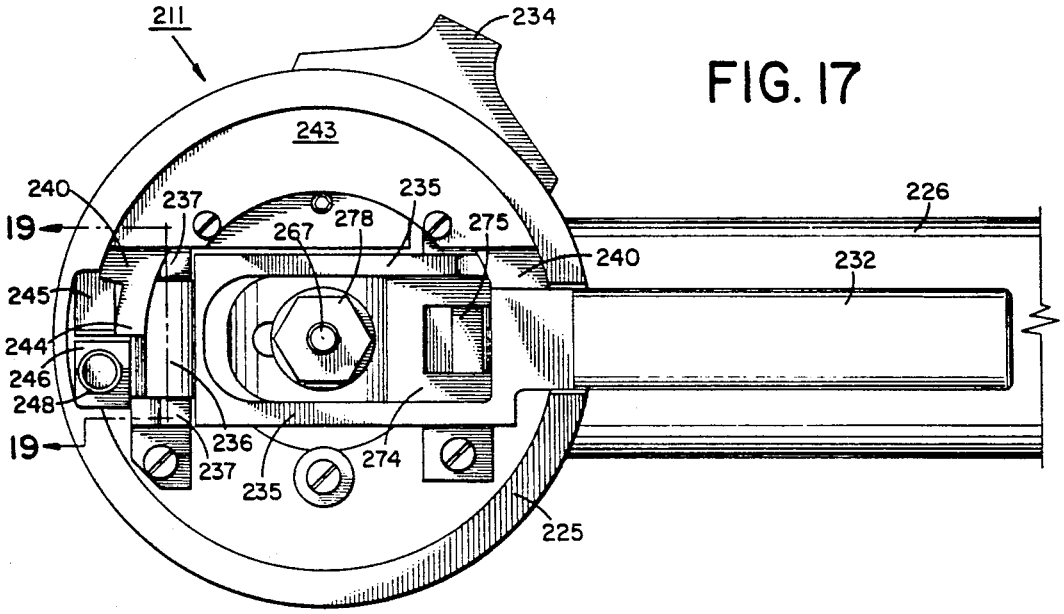
FIG. 17 is an enlarged top plan view of the liquid transfer assembly similar to FIG. 16, but shown with the cover plate removed and the activation switch in the off position.

By referring to FIGS. 16–22, along with the following detailed disclosure, the construction and operation of this safety interlock flow controlling system can best be understood. In this preferred construction, liquid transfer assembly 211 incorporates a flow activation switch 234 mounted along a side surface of housing 225. With activation switch 234 in the off position, as depicted in FIGS. 16 and 17, movement of flow controlling lever 232 is prevented. Consequently, unauthorized or improper activation of flow controlling lever 232 is eliminated since individuals unfamiliar with the system would be unaware of the requirement that switch 234 must be moved from its "off" or locked position to its "on" or disengaged position.

As best seen in FIGS. 17, 18, 21 and 22, flow controlling lever 232 incorporates a substantially open rectangular frame portion 235 positioned in the top of housing 225 of liquid transfer assembly 211. Frame portion 235 peripherally surrounds and controllably engages a cam rocker 274 which lowers a valve assembly which controls the flow of the liquid. All of these components are detailed below.

In addition, frame portion 235 of lever 232 incorporates a boss 236 extending at the forward end thereof. Furthermore, boss 236 is positioned between two upstanding posts 237 and supportingly retained therebetween by pivot pin 238 extending between both posts 237, supportingly maintaining boss 236. In this way, lever 232 is pivotable about the axis defined by pin 238.

In order to enable switch 234 to be able to maintain lever 232 in a locked, immovable position, activation switch 234 controllably engages a movable plate 240 which is peripherally surrounded and retained in cover 243 mounted to housing 225. One terminating end of movable plate 240 is positioned directly adjacent frame portion 235 of lever 232.

In the preferred construction, movable plate 240 incorporates an elongated finger portion 241 extending from one end of plate 240 directly adjacent lever 232. In addition, lever 232 incorporates a finger receiving recess formed therein and positioned for cooperation with finger portion 241.

Figure 18:
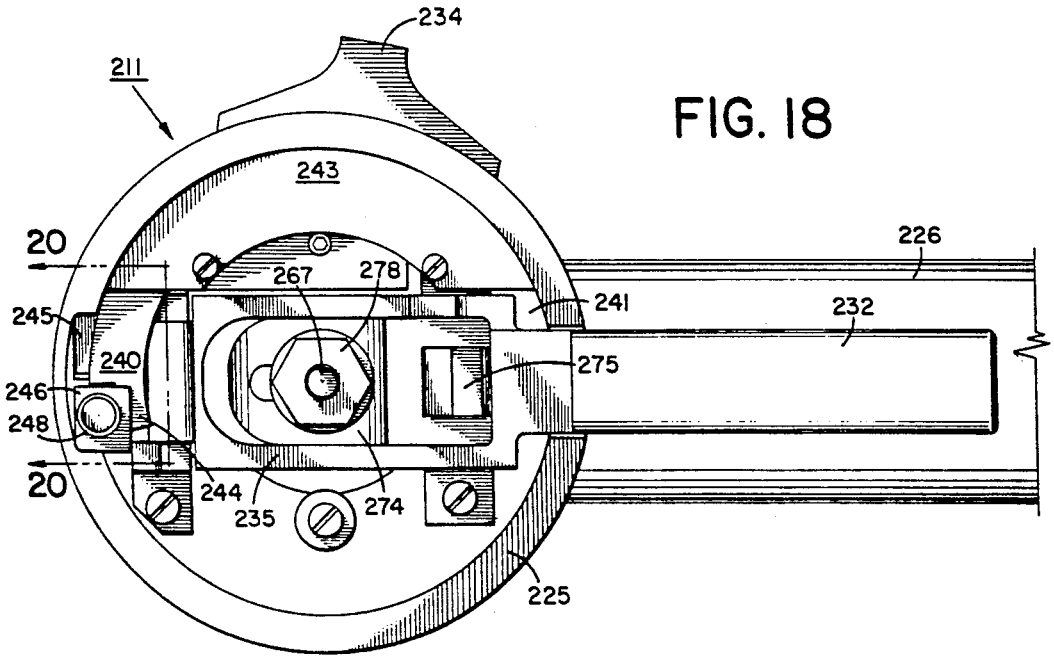
FIG. 18 is a top plan view of the liquid transfer assembly similar to FIG. 17, depicting the activation switch in the on position.

As is depicted in FIGS. 17 and 18, when switch 234 is in the "off" or locked position (FIG. 17), finger portion 241 is engaged within the finger receiving recess of lever 232. As a result, movement of lever 232 is prevented and activation of the flow is incapable of being achieved. However, when switch 234 has been moved from its "off" or locked position to its "on" or open position, as depicted in FIG. 18, finger portion 241 is disengaged from the finger receiving recess of lever 232, and lever 232 is now able to be raised for activation of the desired flow.

Although this single lever activation switch would be capable of providing some degree of certainty that liquid transfer assembly 211 is used properly, the present invention incorporates further interlock systems to substantially increase and enhance the operation of liquid flow assembly 211 and provide positive, substantially complete assurance that liquid transfer assembly 211 is activated into its flow permitting position only when complete, secure, locked interengagement with liquid delivery/filling assembly 212 is properly attained.

Part of this further enhanced interlocking assembly is best understood by referring to FIGS. 17-22, along with the following detailed disclosure. As is evident from these figures, movable plate 240 also incorporates a second finger portion 244, which extends from the opposite end of movable plate 240 and is positioned in juxtaposed, spaced, cooperating relationship with stop bracket 246.

In the preferred construction, stop bracket 246 comprises a substantially "U" shape, with the base thereof securely affixed to the proximal end of elongated rod 247. In addition, a spring member 248 is mounted to the opposed, top surface of bracket 246, thereby biasing the entire assembly downwardly, with the bottom surface of bracket 246 being normally maintained in contact with support platform 239 of housing 225. In addition, in this normal biased position, the distal end of elongated rod 247 extends outwardly from housing 225.

In a similar construction, cam means 245 is mounted at its base to elongated rod 249 with spring means 250 positioned about elongated rod 249 directly adjacent the base of cam means 245 on one side and platform 239 on the opposed side, thereby normally biasing rod 249 cam means 245 upwardly, into housing 225.

Figure 21:
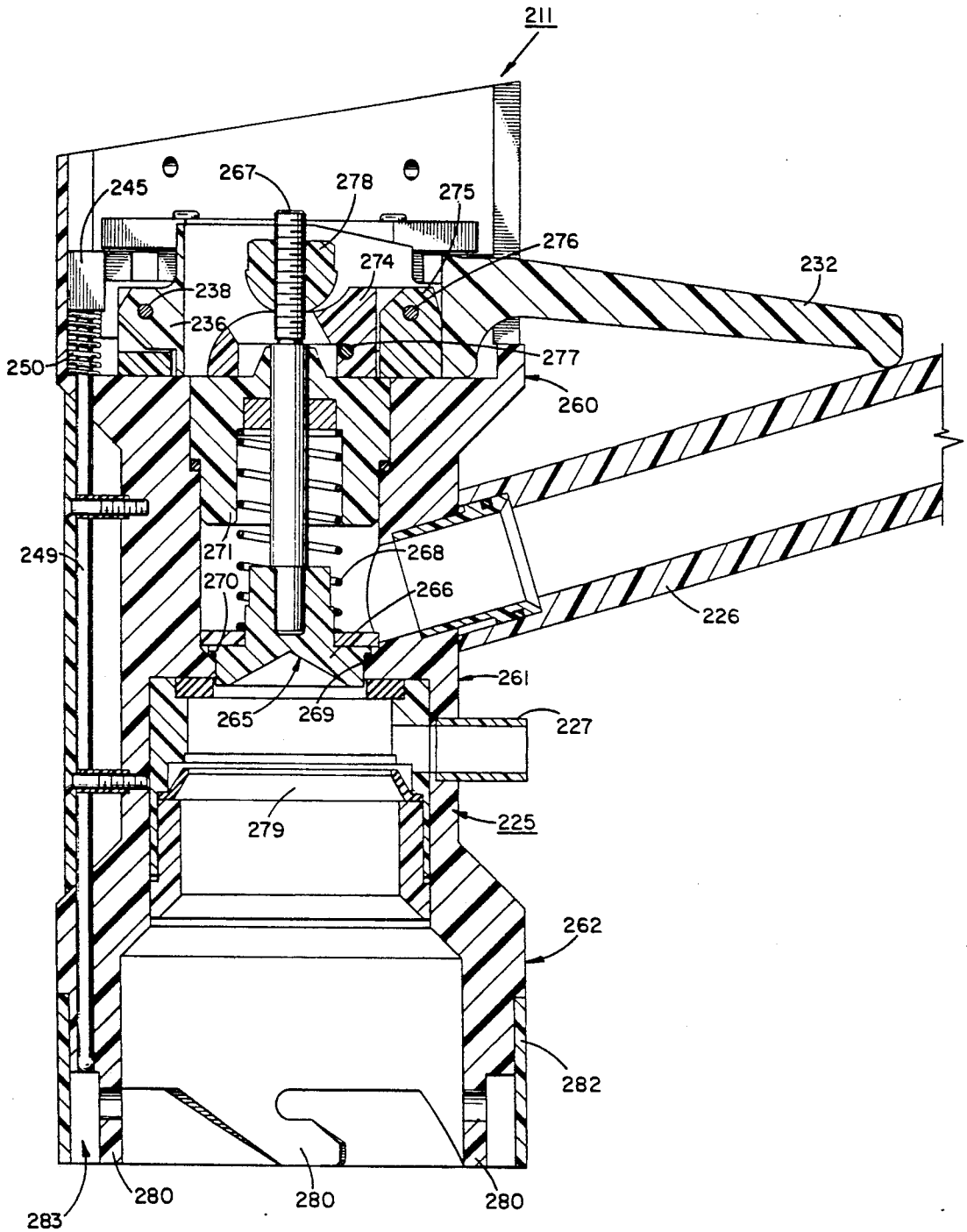
FIG. 21 is a cross-sectional side elevation view of the liquid transfer assembly of the present invention taken along line 21—21 of FIG. 17.

As is apparent from the drawings, both elongated rods 247 and 249 are mounted in housing 225 of liquid transfer assembly 211 in juxtaposed, spaced, parallel relationship to each other, as well as in parallel relationship with the central axis of housing 225. In addition, in the disconnected configuration, as depicted in FIGS. 14 and 21, the distal end of elongated rod 247 extends outwardly from housing 225. Since spring means 248 is mounted on the top of "U-shaped" stop bracket 246, bracket 246 is maintained in contact with platform 239, and the terminating distal end of elongated rod 247 is continuously maintained in its fully extended position, unless counteracted by another force.

In the preferred construction of the second rod assembly, spring member 250 is positioned between the base of cam means 245 and platform 239, thereby maintaining cam means 245 in its raised position, with elongated rod 249 maintained within housing 225, until cam means 245 has been forced by movable plate 240 to move in a downward direction, causing the terminating distal end of elongated rod 249 to extend out of housing 225.

As fully depicted in the drawings, activation switch 234 cannot be moved from its "off" position to its "on" position until liquid transfer assembly 211 has been mounted into secure, locked, complete interengagement with liquid delivery/filling assembly 212. As shown in FIGS. 17 and 19, when liquid transfer assembly 211 is disconnected from liquid delivery/filling assembly 212, the upper portion of "U-shaped" stop bracket 246 prevents the complete movement of switch means 234 from its "off" position to its "on" position.

As depicted therein, the leading edge of finger portion 244 directly abuts stop bracket 246, thereby preventing the movement of plate 240 by switch means 234. As a result, when liquid transfer assembly 211 is disconnected from liquid delivery/filling assembly 212, any individual attempting to activate or employ lever 232 is prevented from doing so and liquid flow cannot be achieved. Consequently, unwanted or unauthorized dispensing of the liquid connected to liquid transfer assembly 211 is prevented.

Whenever liquid transfer assembly 211 is mounted to liquid delivery/filling assembly 212, one surface of narrow cylindrical wall 294 of liquid delivery/filling assembly 212 (FIGS. 15, 23 and 24) contacts the terminating end of elongated rod 247, causing rod 274 to be axially moved upwardly into fully retained engagement within housing 225. This axial movement is in opposition to the forces caused by spring 248 and causes stop bracket 246 to be raised, bringing recess zone 253 of "U-shaped" stop bracket 246 into alignment with finger portion 244 of plate 240.

Once in its fully raised position, finger portion 244 is capable of being moved into recess zone 253 of stop bracket 246, thereby enabling switch 234 to be moved from its "off" position to its "on" position. As is clearly evident from this disclosure, flow controlling lever 232 can only be activated by the movement of switch 234 from its "off" position to its "on" position, when the entire liquid transfer assembly 211 has been mounted to liquid delivery filling assembly 212 in a mated, interengaged configuration.

As a further enhancement and positive protection for providing complete assurance that liquid transfer assembly 211 is fully and completely lockingly interengaged in mated connection with liquid delivery/filling assembly 212, prior to enabling lever 232 to be activated, elongated rod 249 must be positioned in one of a plurality of rod receiving zones 255 formed in cylindrical wall 294 of liquid delivery/filling assembly 212. As clearly shown in FIG. 23, rod receiving zones 255 are formed in liquid delivery/filling assembly 212 at various locations representing the alternate positions at which liquid transfer assembly 211 could be properly securely lockingly interengaged with liquid delivery/filling assembly 212 for proper dispensing of the chemicals or liquids from the tank to the container.

As is evident from the foregoing discussions, before switch 234 can be moved from its "off" position to its "on" position, finger portion 244 must be moved into nested engagement within recess 253 of stop bracket 246. However, before finger portion 244 can enter recess zone 253, plate 240 must contact can means 245, and cause cam means 245 to move downwardly against the biasing force of spring 250 when liquid transfer assembly 211 is mounted to liquid delivery/filling assembly 212, recess zone 253 is moved upwardly into alignment with finger portion 244.

If liquid transfer assembly 211 has not been properly positioned in locked interengagement with liquid delivery filling assembly 212, none of the pin receiving recesses 255 will be in alignment with elongated pin 249. Under these conditions, switch means 234 cannot be moved since plate 240 will engage cam means 245 and be unable to move cam means 245 and rod 249 vertically downwardly, since elongated rod 249 is not positioned in vertical alignment with a rod receiving zone 255 of liquid delivery/filling assembly 212.

Of course, when liquid transfer assembly 211 is properly mounted in secure locked interengagement with liquid delivery filling assembly 212, switch 234 can be quickly and easily moved from its "off" position to its "on" position, with movable plate 240 causing the terminating distal end of pin 249 to be moved into engagement with rod receiving zone 255 of liquid delivery/filling assembly 212, while finger portion 244 enters recess 253 of stop bracket 246. Once in this position, lever 232 can be activated, whenever desired, in order to fill the container to which liquid delivery/filling assembly 212 is securely affixed.

It should also be evident from this disclosure that whenever liquid transfer assembly 211 is securely and properly mounted to liquid delivery/filling assembly 212, and liquid flow has been initiated, accidental or purposeful removal of liquid transfer assembly 211 from liquid delivery/filling assembly 212 is impossible. As detailed above, before lever 232 can be activated, causing liquid flow to occur, the terminating end of elongated rod 249 is positioned in secure engagement with a rod receiving zone 255 of liquid delivery/filling assembly 212.

Consequently, disengagement of liquid transfer assembly 211 from liquid delivery/filling assembly 212, while flow is occurring, is completely prevently. As a result, unwanted disconnection of integrated, cooperating liquid flow controlling system 210 of this invention is provided and spillage during the dispensing operation is completely avoided.

Figure 22:
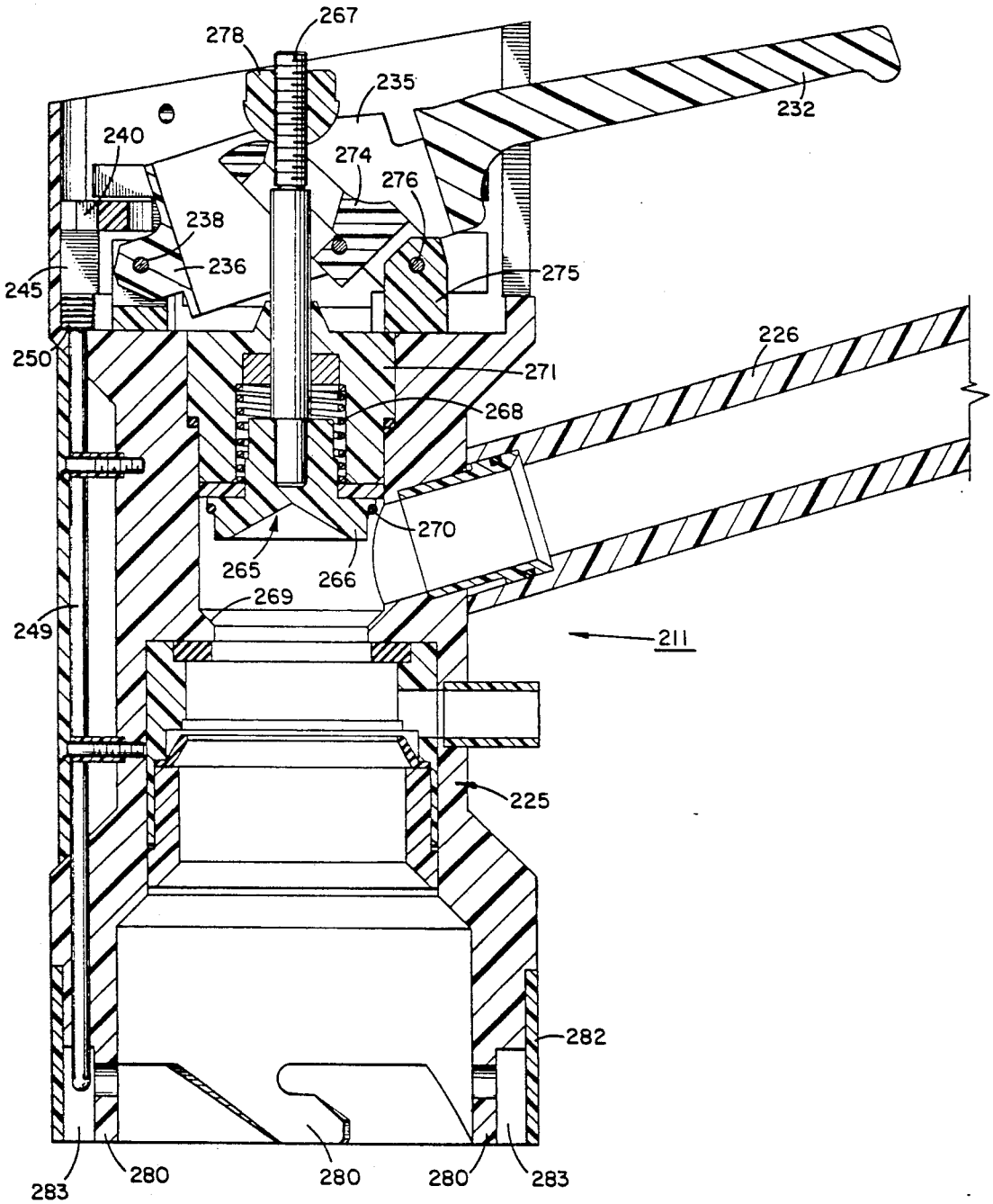
FIG. 22 is a cross-sectional side elevation view of the liquid transfer assembly similar to the view of FIG. 21, depicting the liquid transfer assembly in its fully activated position.
Figure 23:
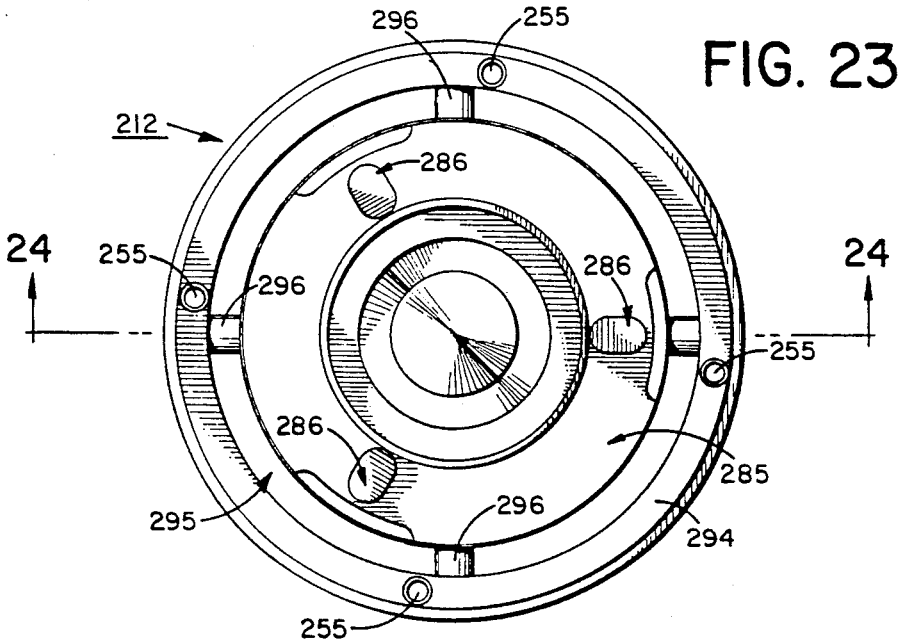
FIG. 23 is a top plan view of an alternate preferred embodiment of the liquid delivery/filling assembly of this invention.

As best seen in FIGS. 21 and 22, housing 225 of mating, interlocking, liquid transfer assembly 211 incorporates an upper valve and lever retaining body portion 260, a central body portion 261, and a peripherally surrounding, depending wall portion 262, which extends from central body portion 261 in a direction opposite from upper body portion 260. Preferably, upper body portion 260, central body portion 261 and wall portion 262 are formed substantially in their entirety from a single, integrated component and are manufactured from material which is best suited to be unaffected by the liquid being dispensed.

At the juncture between upper body portion 260 and central body portion 261, liquid flow channel 226 is positioned for delivering the desired liquid to housing 225 for being dispensed at the proper time. In order to assure that the liquid transferral occurs only when precisely desired, valve assembly 265 is mounted in housing 225.

In the preferred embodiment, valve assembly 265 incorporates a movable valve plate 266 which is controllably movable along the central axis of housing 225 by axially disposed elongated rod 267. Preferably, the distal end of elongated rod 267 is securely affixed in valve plate 266, thereby controlling the axial movement of plate 266.

In addition, coil spring means 268 is preferably mounted about elongated rod 267 and maintained under compression, biasingly forcing valve plate 266 into secure, liquid flow stopping engagement with valve receiving/seating surface 269 of housing 225. Furthermore, in order to assure that no liquid is capable of penetrating between valve plate 266 and valve receiving/seating surface 269, a sealing ring 270 is mounted to valve plate 266 for being brought into contacting, sealing engagement with valve seating surface 269.

With the liquid flow channel 226 positioned directly above valve plate 266 and valve seating surface 269, any liquid flowing in through flow channel 226 is prevented from being dispensed, due to the sealed engagement between valve plate 266 and valve seating surface 269. In addition, a centrally disposed plug 271 is mounted in upper portion 260 of housing 225 for maintaining spring 268 under compression, while also assuring continuous, liquid flow preventing interengagment between valve plate 266 and valve seating surface 269. In addition, plug 271 also prevents any chemical or toxic liquid entering through passageway 226 from being dispensed or leaked out of housing 225.

In order to enable lever 232 to controllably activate or initiate the chemical or toxic liquid flow, when desired, lever 232 is constructed for controlling the axial movement of elongated rod 267. In order to attain this precise, dependable, trouble-free control, cam rocker 274 is mounted in upper body portion 260 of housing 225 with a portion thereof peripherally surrounding and retainingly engaging elongated rod 267. In addtition, one end of cam rocker 274 is pivotally mounted to upstanding posts 275 by pin means 276.

Furthermore, control pin 277 extends through cam rocker 274, with the terminating ends thereof engaged within an arcuate slot formed in frame portion 235 of lever 232. Finally, in order to assure controlled movement of elongated rod 267 by cam rocker 274, a cam following nut is threadedly engaged with rod 267, with the cam surface thereof in sliding, contacting engagement with cam rocker 274.

By employing this construction, the upward movement of lever 232, when able to be activated as detailed above, causes frame portion 235 of lever 232 to be lifted upwardly in the same direction. Since elongated pin 277 is captured by frame portion 235, the movement of lever 232 also causes elongated pin 277 to be similarly raised.

Since pin 277 extends through cam rocker 274, the movement of control pin 277 causes cam rocker 274 to pivot relative to post 275 about the axis defined by pin 276. This movement of cam rocker 274 causes cam nut 278 to be moved therewith, simultaneously drawing elongated rod 276 upwardly in the identical direction. With the distal end of elongated rod 267 threadedly mounted valve plate 266, the upward movement of rod 267 causes valve plate 266 to also be moved upwardly, against the biasing forces of spring 268, disengaging the surface thereof from valve seat 269 and enabling the chemical or toxic liquid to flow therebetween. This open position is depicted in FIG. 22.

Central body portion 261 incorporates a through hole formed therein in which flow channel 227 is securely affixed. In this way, the air exiting the container into which the fluid is being dispensed is controllably channeled so as to assure its proper disposal, if necessary. In addition, in the preferred embodiment, sealing ring 279 is mounted in the internal diameter of central body portion 261 for cooperative, sealing interengagement with slidable collar 285 of liquid delivery/filling assembly 212. Sealing ring 279 provides further assurance that no chemical or toxic liquid is capable of being accidentally leaked from the integrated, cooperating, liquid flow controlling system 210 of this invention.

In the preferred construction of this embodiment, as with the alternate embodiment detailed above, wall portion 262 comprises a substantially hollow cylindrical shape which terminates at its lower end with a plurality of slotted rod locking fingers 280. Each of the elongated, slotted fingers 280 of wall portion 262 are constructed for mating, locked interengagement with finger receiving rods 296 formed on liquid delivery/filling assembly 212. In this way, secure, interlocked, interengagement of liquid transfer assembly 211 with liquid delivery/filling assembly 212 is assured.

Finally, the construction of liquid transfer assembly 211 is completed by mounting a substantially cylindrically shaped flange member at the lower end of wall portion 262 directly adjacent elongated, rod capturing fingers 280. As clearly depicted in FIGS. 21 and 22, cylindrical flange member 282 cooperates with rod capturing fingers 280 to form an angular recess zone 283 therebetween. Furthermore, the terminating distal end of elongated rod 247 and rod 249 is positioned in recess 283. Due to the narrow dimension provided for annular recess zone 283, an operator is incapable of inserting his finger to move rod 247 upwardly, to enable switch 234 to be activated. Consequently, further protection is provided over unwanted or purposeful activation of lever 232 when not lockingly interengaged with liquid delivery/filling assembly 212 in the desired manner.

In FIGS. 15 and 23-25, a further alternate embodiment of the liquid delivery/filling assembly of this invention is depicted. In this embodiment, liquid delivery/filling assembly 212 is constructed in the substantially identical basic configuration detailed above in reference to the alternate embodiments shown and disclosed herein. In fact, if desired, the alternate embodiments detailed above could be employed directly with integrated, mating liquid transfer assembly 211, provided the interlocking enhancement discussed above are incorporated therein.

In addition to the incorporation of rod-receiving zones 255 in liquid delivery/filling system 212, as detailed above, this embodiment of liquid delivery/filling assembly 212 also incorporates a positive activation lock system to prevent the unwanted or unauthorized opening of liquid delivery/filling assembly 212. In order to assure that liquid delivery/filling assembly 212 is in mated interengagement with either liquid transfer assembly 211 or an appropriately constructed tank or reservoir, slidable collar 285 incorporates a plurality of movable actuators 286 which must be moved simultaneously in order to enable collar 285 to be moved axially for opening liquid delivery/filling assembly 212.

Figure 24:
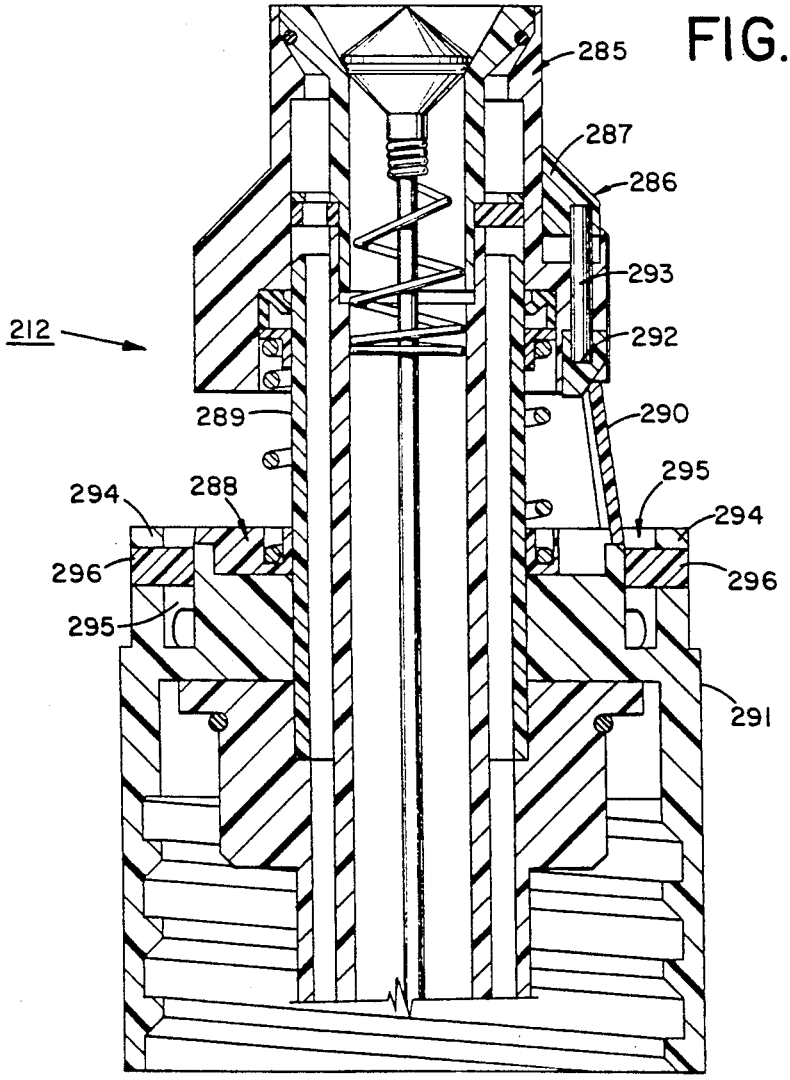
FIG. 24 is a cross-sectional side elevation view, partially broken away, of the alternate preferred embodiment of the liquid delivery/filling assembly of FIG. 23, taken along line 24—24 of FIG. 23, and showing the normally closed position.

In this preferred embodiment, a locking plate 288 is mounted about tube 289 and incorporates a plurality of upstanding flanges 290. Each upstanding flange 290 is formed to extend inwardly, so that the terminating end of each flange 290 abuts the underside of slidable collar 285. As a result, in its unactivated configuration, as depicted in FIG. 24, slidable collar 285 cannot be axially moved downwardly, due to the engagement of upstanding flange 290 with collar 285 and actuators 286.

Before slidable collar 285 can be axially moved along tube 289 to open liquid delivery/filling assembly 212, each of the flanges 290 must be moved outwardly, so that its terminating end does not interfere with the movement of slidable collar 285. As clearly shown in FIGS. 24 and 25, this requisite outward movement is achieved by simultaneously pressing each actuator 286.

In this embodiment, each actuator 286 comprises an upstanding contact post 287 normally extending upwardly in collar 285 and connected to cam block 292 by pin 293. In this normal position, depicted in FIG. 24, flange 290 contacts cam block 292, preventing movement of collar 285 and maintaining post 287 in its raised position.

Figure 25:
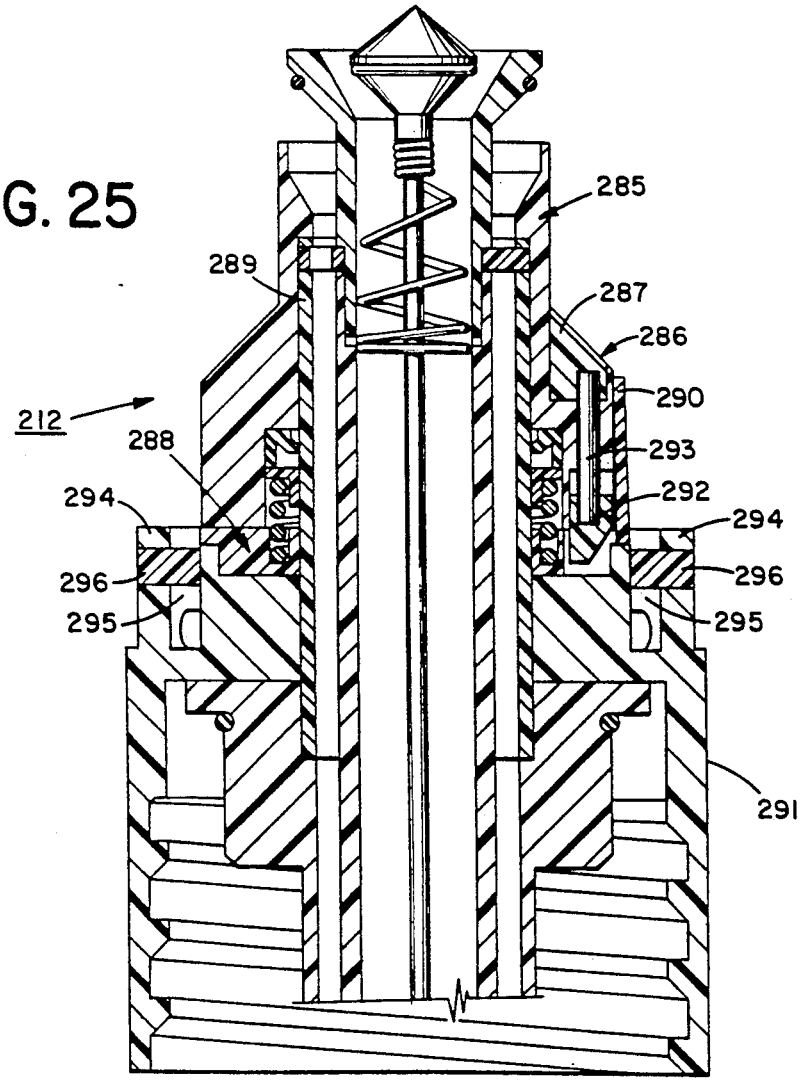
FIG. 25 is a cross-sectional side elevation view, partially broken away, of the liquid delivery/filling assembly of FIG. 24, shown in the open position.

Whenever post 287 is pushed downwardly, against the spring forces of flange 290, the flange engaging surface of cam block 292 contacts the terminating end of flange 290, causing flange 290 to be moved outwardly away from the bottom surface of slidable collar 285. When fully moved downwardly, collar 285 is free to move axially. This open position is shown in FIG. 25.

In the preferred embodiment, three actuator assemblies 186 are employed in order to prevent purposeful activation of the liquid delivery/filling assembly 212 when not properly interconnected with a mating component. By employing at least three actuator assemblies, substantial difficulty is encountered if manual activation is attempted. Consequently, any purposeful or accidental attempt to open liquid delivery/filling assembly 212 is virtually eliminated.

Directly adjacent the positioning of locking plate 288, container engaging sealing cap 291 incorporates a cylindrically shaped upstanding wall 294, the top surface of which incorporates the rod receiving zones 255. In addition, directly adjacent upstanding wall 294 recess zone 295 is formed with a plurality of pins 296 radially mounted therein.

In this embodiment, the width of recess zone 295 is slightly greater than the thickness of locking fingers 280 of liquid transfer assembly 211, thereby allowing locking fingers 280 of liquid transfer assembly 211 to telescopically enter recess zone 295 and, when rotated in the proper direction, engage pins 296 in secure locked engagement. Furthermore, when aligned in a precisely desired locked interengaged position, at least one of the post receiving zones 255 is aligned with elongated pin 249 for secure, locked interengaged receipt thereof.

In addition, upstanding cylindrical wall 294 comprises a thickness which enables upstanding wall 294 to matingly engage within annual recess 283 of liquid transfer assembly 211. As detailed above, narrow annular recess 283 is constructed for telescopically receiving cylindrical wall 294 and enable wall 292 to cause elongated rod 247 to be moved upwardly, thereby enabling switch 234 to be activated in the manner detailed above.

As is apparent from the preceding disclosure, the present invention attains a fool-proof, interlocking, integrated liquid flow controlling system which virtually eliminates any spillage of the liquid being dispensed. By employing this invention, liquids of any type or composition can be safely dispensed in an unpressurized, gravity-free system with complete safety.

Figure 27:
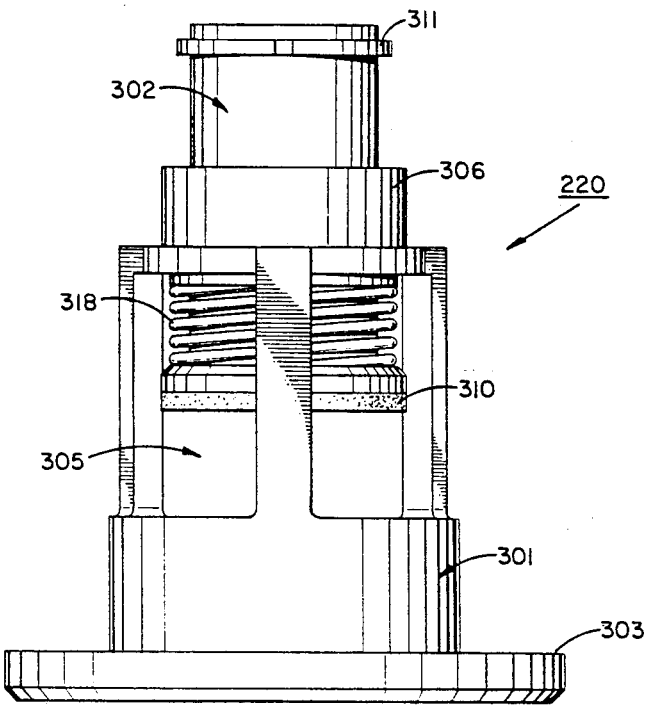
FIG. 27 is a side elevation view, depicting the tank insert of FIG. 24 in the open position.
Figure 26:
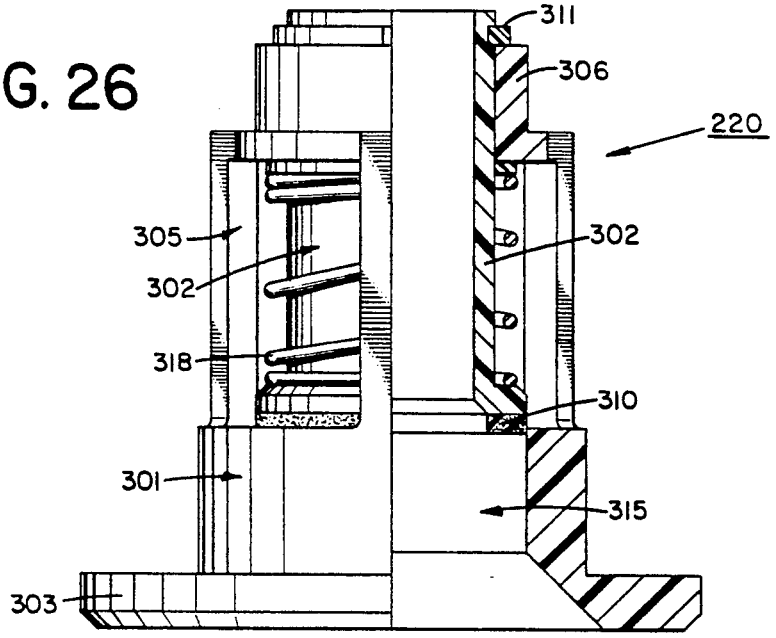
FIG. 26 is a side elevation view, partially in cross-section, depicting the preferred construction for a tank or reservoir insert, depicted in the closed position.

In FIGS. 26 and 27, a preferred embodiment for a supply or reservoir tank adaptor or insert is depicted. As previously detailed above in reference to the alternate embodiments of this invention, the liquid delivery/filling assembly of this invention can be employed with any desired tank or reservoir to dispense the desired liquid from the container to the reservoir for use or dilution. However, in order to assure complete trouble-free, spill-free transferral of the liquid from the container to the tank or reservoir, tank insert 220 is preferred. In particular, when liquid delivery/filling assembly 212 is employed, with the interlock feature detailed above, the tank insert 220 is preferred to assure mating contacting engagement with acutator 286 of assembly 212.

As depicted in FIGS. 25 and 26, tank adaptor or insert 220 comprises an outer housing 301 and a mating, telescopially engaged, co-axially aligned cylindrical tube member 302. In the preferred embodiment, housing 301 comprises a hollow cylindrical shape and incorporates an enlarged flange/collar 303 formed on one end thereof. Flange/collar 303 preferably incorporates a conical surface extending from the top of collar 303 extending into the central open zone of housing 301. This conical surface is constructed for mating, interengagement with liquid delivery/filling assembly 212.

Housing 301 of insert 220 also incorporates substantially enlarged open zones 305 formed therein, enabling the easy transferral of displaced air therethrough. Finally, the base of housing 301 incorporates a tube receiving upstanding ring 306 forming the opposed terminating end of housing 301 and providing a receiving and holding portal for tube member 302.

As depicted, a cylindrical tube 302 is positioned within the central aperture of ring 306 for concentric, co-axial, sliding movement therein. Furthermore, in order to assure that cylindrical tube 302 is captured within housing 301, both ends of cylindrical tube 302 incorporate enlarged terminating end flanges 310 and 311 peripherally surrounding tube 302, preventing the axial withdrawal of tube 302 from upstanding ring 306.

In the preferred construction, collar engaging flange 310 of tube 302 comprises flexible liquid sealing material which peripherally surroundes tube 302 and is constructed for mating, sealing, interengagement with the central aperture 315 of flange/collar 303. In addition, spring means 318 is mounted between sealing flange 310 and ring 306 of housing 301 for continuously urging and biasingly maintaining telescopically movable cylindrical tube 302 in sealed engagement with aperture 315 of flange/collar 303.

In normal use, supply tank insert 220 is maintained in its sealed position, with sealing flange 310 of cylindrical tube 302 continuously maintained in sealing interengagement with portal 315 of flange/collar 303. Whenever the supply tank is to be refilled, with the desired chemical or liquid, liquid delivery/filling assembly 212 is quickly and easily inserted into position in mating, cooperating engagement with flange/collar 303 of insert 220.

If the liquid delivery/filling assembly being employed incorporates the locking actuators detailed above, the contacting engagement of the actuators with the conical surface of collar 303 automatically causes the actuators to disengage the locking flanges, enabling liquid delivery/filling assembly 212 to be activated. In addition, simultaneously with the activation thereof, cylindrical tube 302 of insert 220 is axially moved inwardly, enabling the liquid to flow through the central aperture of cylindrical tube 302 in the precisely desired completely controlled manner, while the displaced air exits through enlarged open zones 305 into the container through the liquid delivery/filling assembly 212.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. An integrated, cooperating liquid flow controlling system for delivering a desired liquid from a first storage reservoir to a second active reservoir and also for providing trouble-free refilling of the first storage reservoir whenever required, with all of the liquid transfer being achieved in a controlled manner with over-filling, spillage, and pressure build up virtually eliminated, said flow controlling system comprising A. a liquid delivery/filling assembly comprising
   a. a first flow channel;
   b. a second, separate and independent flow channel positioned for cooperative association with said first flow channel;
   c. actuation control means cooperatively associated with said first flow channel and said second flow channel for opening the flow channels whenever activated; and
   d. interconnection means formed thereon and positioned for interengagement with cooperating connection means; and B. a liquid transfer assembly constructed for mating, cooperating mounted engagement with the liquid delivery/filling assembly and comprising
   a. a housing constructed for cooperating, mating, telescopic overlying interengagement with the liquid delivery/filling system assembly, for activating the actuation control means thereof and maintaining said actuation control means in the open position until removed therefrom, and comprising connection means positioned for mating engagement with the interconnection means of the liquid delivery/filling assembly,
   b. a valve assembly mounted in the housing and incorporating
      1. a liquid inlet portal connectable to a source of said liquid, and
      2. flow control means movable between a first flow stopping position and a second flow permitting position, and
   c. interlock means
      1. mounted in the housing and controllably connected to the flow control means of the valve assembly for preventing movement of said flow control means whenever desired,
      2. enabling the actuation of the flow control means only when the liquid transfer assembly is securely, matingly, cooperatingly mounted in the desired interengagement with the liquid delivery/filling assembly, and 3. comprising disconnection preventing means cooperatively associated with the liquid delivery/filling assembly to prevent relative rotation of said components, said disconnection preventing means being automatically activated during the actuation of said flow control means and cooperating with the mated connection means of the housing and the interconnection means of the liquid delivery/filling assembly to prevent separation of the liquid transfer assembly from the liquid delivery/filling assembly whenever the desired liquid is flowing therethrough, whereby assurance is provided that the integrated, cooperating liquid flow controlling system of this invention is securely mounted in the precisely desired position prior to enabling any liquid flow to occur.

2. The integrated, cooperating, liquid flow controlling system defined in claim 1, wherein said liquid transfer assembly is further defined as comprising d. an actuation lever pivotally mounted to the housing and controllably connected to the valve assembly for moving the flow control means from its first flow stopping position to its second flow permitting position.

3. The integrated, cooperating mating liquid flow controlling system defined in claim 2, wherein said liquid transfer assembly is further defined as comprising e. switch means mounted to said housing and movable between a first lever engaging position and a second lever release position, whereby movement of said lever is prevented when the switch means is in its first position, while movement of the actuation lever is enabled when said switch means has been moved to its second position.

4. The integrated, cooperating liquid flow controlling system defined in claim 1, wherein said liquid transfer assembly is further defined as comprising a sealing ring mounted in the housing for sealing interengagement with the actuation control means of the liquid delivery/filling assembly, when said actuation control means is in its fully open position.

5. The integrated, cooperating mating liquid flow controlling system defined in claim 1, wherein the housing of the liquid transfer assembly is further defined as incorporating vent means to enable air to exit from the inside of said housing to the outside thereof.

6. The integrated, cooperating mating liquid flow controlling system defined in claim 1, wherein the interconnection means of the liquid delivery/filling assembly is further defined as comprising a plurality of radially extending pins peripherally surrounding the actuation control means, and said housing of the liquid transfer assembly is further defined as comprising at least one depending flange member extending from said housing and incorporating pin receiving slots positioned for lockingly engaging the radially extending pins mounted on the liquid delivery/filling system when the control means of the liquid delivery/filling system has been fully activated and both the first and second flow channels thereof are opened.

7. The integrated, cooperating mating liquid flow controlling system defined in claim 6, wherein said housing is further defined as being constructed for telescopic interengagement with the liquid delivery/filling assembly for providing automatic, control actuation of the liquid delivery/filling assembly and the maintenance of the liquid delivery/filling assembly in the open position when said housing is lockingly engaged therewith.

8. The integrated, cooperating mating liquid flow controlling system defined in claim 1, wherein the liquid being transferred is further defined as comprising a flammable, highly volatile liquid.

9. The integrated, cooperating mating liquid flow controlling system defined in claim 1, wherein said liquid is further defined as comprising a toxic or hazardous chemical liquid.

10. The integrated, cooperating mating liquid flow controlling system defined in claim 9, wherein said liquid comprises one selected from the group consisting of pesticides, fertilizers, and insecticides.

11. The integrated, cooperating mating liquid flow controlling system defined in claim 1, wherein both the first and second flow channels of the liquid delivery/filling assembly are further defined as being positioned concentrically to each other.

12. The integrated, cooperating mating liquid flow controlling system defined in claim 11 wherein both the first and second flow channels are further defined as being normally maintained in a closed, sealed configuration, requiring the application of an actuation force to open said flow channels.

13. An integrated, cooperating mating liquid flow controlling system for delivering a desired liquid from a first storage reservoir to a second active reservoir and also for providing trouble-free refilling of the first storage reservoir whenever required, with all of the liquid transfer being achieved in a controlled manner with over-filling, spillage, and pressure build up virtually eliminated, said flow controlling system comprising A. a liquid delivery/filling assembly comprising
   a. a first flow channel;
   b. a second, separate and independent flow channel positioned for cooperative association with said first flow channel; and
   c. actuation control means cooperatively associated with said first flow channel and said second flow channel for opening the flow channels whenever activated; and B. a liquid transfer assembly constructed for mating, cooperating mounted engagement with the liquid delivery/filling assembly and comprising
   a. a housing constructed for cooperating, mating, telescopic overlying interengagement with the liquid delivery/filling system assembly, for activating the actuation control means thereof and maintaining said actuation control means in the open position until removed therefrom,
   b. a valve assembly mounted in the housing and incorporating
      1. a liquid inlet portal connectable to a source of said liquid, and
      2. flow control means movable between a first flow stopping position and a second flow permitting position, comprising
         i. a valve plate cooperatingly engaged with the housing in cooperating relationship with the liquid inlet portal and movable between a first sealed position and a second, open liquid-flow position,
         ii. an elongated rod mounted at one end to said valve plate with its opposed end controllably connected to the actuation lever for axial movement in response to the movement of the lever, and iii. spring means biasingly engaged with the valve plate for normally maintaining the valve plate in its first, sealed position, while being compressible by the movement of said elongated rod;

c. interlock means mounted in the housing and controllably connected to the flow control means of the valve assembly for preventing movement of said flow control means whenever desired and enabling the actuation of the flow control means only when the liquid transfer assembly is securely, matingly, cooperatingly mounted in the desired interengagement with the liquid delivery/filling assembly;

d. an actuation lever pivotally mounted to the housing and controllably connected to the valve assembly for moving the flow control means from its first flow stopping position to its second flow permitting position; and e. switch means mounted to said housing and movable between a first lever engaging position and a second lever release position, whereby movement of said lever is prevented when the switch means is in its first position, while movement of the actuation lever is enabled when said switch means has been moved to its second position, whereby assurance is provided that the integrated, cooperating liquid flow controlling system of this invention is securely mounted in the precisely desired position prior to enabling any liquid flow to occur.

14. The integrated, cooperating mating liquid flow controlling system defined in claim 13, wherein said valve assembly is further defined as comprising 3. cam means i. pivotally mounted to the housing, ii. controllably connected to the actuation lever for being pivotally moved about its pivot axis in response to the movement of said actuation lever, and iii. cooperatively associated with the elongated rod for axially moving said elongated rod in response to the pivotal movement thereof.

15. An integrated, cooperating mating liquid flow controlling system for delivering a desired liquid from a first storage reservoir to a second active reservoir and also for providing trouble-free refilling of the first storage reservoir whenever required, with all of the liquid transfer being achieved in a controlled manner with over-filling, spillage, and pressure build up virtually eliminated, said flow controlling system comprising A. a liquid delivery/filling assembly comprising a. a first flow channel;

b. a second, separate and independent flow channel positioned for cooperative association with said first flow channel; and c. actuation control means cooperatively associated with said first flow channel and said second flow channel for opening the flow channels whenever activated; and B. a liquid transfer assembly constructed for mating, cooperating mounted engagement with the liquid delivery/filling assembly and comprising a. a housing constructed for cooperating, mating, telescopic overlying interengagement with the liquid delivery/filling system assembly, for activating the actuation control means thereof and maintaining said actuation control means in the open position until removed therefrom, b. a valve assembly mounted in the housing and incorporating 1. a liquid inlet portal connectable to a source of said liquid, and 2. flow control means movable between a first flow stopping position and a second flow permitting position, comprising c. interlock means mounted in the housing and controllably connected to the flow control means of the valve assembly for preventing movement of said flow control means whenever desired and enabling the actuation of the flow control means only when the liquid transfer assembly is securely, matingly, cooperatingly mounted in the desired interengagement with the liquid delivery/filling assembly, and comprising a first position sensing assembly incorporating 1. an elongated rod mounted in the housing of the liquid transfer assembly for axial movement relative thereto 2. a block member mounted on one of its surfaces to the proximal end of said elongated rod and incorporating a recess zone formed therein, and 3. biasing means mounted under compression to the second, opposed end surface of the block member whereby said first sensing assembly is movable between a first normal position wherein said proximal end of said elongated rod extends outwardly from said housing and a second, liquid delivery/filling assembly mated position wherein the distal end of said elongated rod has been forced against the spring biasing forces into its fully withdrawn housing contained position;

d. an actuation lever pivotally mounted to the housing and controllably connected to the valve assembly for moving the flow control means from its first flow stopping position to its second flow permitting position; and e. switch means mounted to said housing and movable between a first lever engaging position and a second lever release position, whereby movement of said lever is prevented when the switch means is in its first position, while movement of the actuation lever is enabled when said switch means has been moved to its second position, whereby assurance is provided that the integrated, cooperating liquid flow controlling system of this invention is securely mounted in the precisely desired position prior to enabling any liquid flow to occur.

16. The integrated, cooperating mating liquid flow controlling system defined in claim 15, wherein said switch means is further defined as comprising an elongated finger extending from one surface thereof into juxtaposed, spaced, cooperating relationship with the block member of the first sensing assembly, positioned for either contacting engagement with said block member whenever the sensing assembly is in its first position or in juxtaposed, spaced, cooperating relationship with the recess zone of said block member whenever said first sensing assembly has been moved into its second position, whereby movement of said switch means is prevented whenever the first sensing assembly is in its first, unmounted position, while enabling movement of said switch means into its second position, whenever the liquid transfer assembly has been securely mounted in engagement with the liquid delivery/filling assembly.

17. The integrated, cooperating liquid flow controlling system defined in claim 15, wherein said interlock means is further defined as comprising 1. a second sensor assembly cooperatingly associated with said first sensor assembly and incorporating a second elongated rod mounted in the housing for axial movement relative thereto between a first housing engaged position and a second housing protruding position wherein the distal end of said rod extends outwardly from the base of the housing,
2. a cam member mounted to the proximal end of the housing, and
3. biasing means mounted about the elongated rod between the cam member and the housing for normally biasing the second sensor assembly in said first housing engaged position.

18. The integrated, cooperating mating liquid flow controlling system defined in claim 17, wherein said second sensor assembly is further defined as being positioned adjacent the first sensor assembly in juxtaposed, spaced, cooperating, controlled contacting engagement with the switch means, whereby movement of said switch means from its first position to its second position causes said switch means to contact a surface of said cam member, forcing said cam member to move against the spring biasing forces, and causing the elongated rod to be moved from its first position to its second, rod-extending position.

19. The integrated, cooperating mating liquid flow controlling system defined in claim 18, wherein said liquid delivery/filling assembly is further defined as incorporating rod receiving recesses formed therein and positioned for receiving and securely retaining the second, elongated rod of said second sensor assembly when the liquid transfer assembly is securely, matingly interengaged with said liquid delivery/filling assembly, whereby disengagement of the liquid transfer assembly from the liquid delivery/filling assembly is prevented whenever the liquid flow controlling system of this invention is in its securely mated interengaged position, with the liquid flow activated.

20. An integrated, cooperating mating liquid flow controlling system for delivering a desired liquid from a first storage reservoir to a second active reservoir and also for providing trouble-free refilling of the first storage reservoir whenever required, with all of the liquid transfer being achieved in a controlled manner with over-filling, spillage, and pressure build up virtually eliminated, said flow controlling system comprising A. a liquid delivery/filling assembly comprising
   a. a first flow channel;
   b. a second, separate and independent flow channel positioned for cooperative association with said first flow channel; and
   c. actuation control means cooperatively associated with said first flow channel and said second flow channel for opening the flow channels whenever activated, and
   d. a plurality of separate and independent actuation lock means mounted to the actuation control means for preventing the movement of actuation control means unless all of said actuation lock means are simultaneously activated; and B. a liquid transfer assembly constructed for mating, cooperating mounted engagement with the liquid delivery/filling assembly and comprising
   a. a housing constructed for cooperating, mating, telescopic overlying interengagement with the liquid delivery/filling system assembly, for activating the actuation control means thereof and maintaining said actuation control means in the open position until removed therefrom,
   b. a valve assembly mounted in the housing and incorporating
      1. a liquid inlet portal connectable to a source of said liquid, and
      2. flow control means movable between a first flow stopping position and a second flow permitting position, and
   c. interlock means mounted in the housing and controllably connected to the flow control means of the valve assembly for preventing movement of said flow control means whenever desired and enabling the actuation of the flow control means only when the liquid transfer assembly is securely, matingly, cooperatingly mounted in the desired interengagement with the liquid delivery/filling assembly;

whereby assurance is provided that the integrated, cooperating liquid flow controlling system of this invention is securely mounted in the precisely desired position prior to enabling any liquid flow to occur.

21. An integrated, cooperating mating liquid flow controlling system for delivering a desired liquid from a first storage reservoir to a second active reservoir and also for providing trouble-free refilling of the first storage reservoir whenever required, with all of the liquid transfer being achieved in a controlled manner with over-filling, spillage, and pressure build up virtually eliminated, said flow controlling system comprising A. a liquid delivery/filling assembly comprising
   a. a first flow channel;
   b. a second, separate and independent flow channel positioned for cooperative association with said first flow channel; and
   c. actuation control means cooperatively associated with said first flow channel and said second flow channel for opening the flow channels whenever activated, and
   d. an actuation locking system comprising
      1. a first member mounted in cooperating relationship with actuation control means and movable between a first control means stopping position and a second position wherein said control means is freely movable, and
      2. a cam post assembly mounted to the actuation control means and movable relative thereto between a first position, wherein said post assembly is in contact with the first member in the first position thereof and a second activated position, wherein said first member is moved out of blocking engagement of said actuation control means, thereby enabling free movement of said actuation control means; and B. a liquid transfer assembly constructed for mating, cooperating mounted engagement with the liquid delivery/filling assembly and comprising
   a. a housing constructed for cooperating, mating, telescopic overlying interengagement with the liquid delivery/filling system assembly, for activating the actuation control means thereof and maintaining said actuation control means in the open position until removed therefrom, b. a valve assembly mounted in the housing and incorporating
   1. a liquid inlet portal connectable to a source of said liquid, and
   2. flow control means movable between a first flow stopping position and a second flow permitting position, c. interlock means mounted in the housing and controllably connected to the flow control means of the valve assembly for preventing movement of said flow control means whenever desired and enabling the actuation of the flow control means only when the liquid transfer assembly is securely, matingly, cooperatingly mounted in the desired interengagement with the liquid delivery/filling assembly;

whereby assurance is provided that the integrated, cooperating liquid flow controlling system of this invention is securely mounted in the precisely desired position prior to enabling any liquid flow to occur.

22. The integrated, cooperating liquid flow control system defined in claim 21, wherein the actuation lock system comprises a plurality of upstanding members preventing the actuation control means from being actuated and a plurality of cooperating post means for controllably moving said members, whereby simultaneous actuation of said plurality of members and pins means must be achieved before the actuation control means can be activated.

23. An integrated, cooperating liquid flow controlling system for delivering a desired liquid from a first storage reservoir to a second active reservoir and also for providing trouble-free refilling of the first storage reservoir whenever required, with all of the liquid transfer being achieved in a controlled manner with over-filling, spillage, and pressure build up virtually eliminated, said flow controlling system comprising A. a liquid delivery/filling assembly comprising
   a. a first flow channel;
   b. a second, separate and independent flow channel positioned for cooperative association with said first flow channel; and
   c. actuation control means cooperatively associated with said first flow channel and said second flow channel for opening the flow channels whenever activated; and B. a liquid transfer assembly constructed for mating, cooperating mounted engagement with the liquid delivery/filling assembly and comprising
   a. a housing constructed for cooperating, mating, telescopic overlying interengagement with the liquid delivery/filling system assembly, for activating the actuation control means thereof and maintaining said actuation control means in the open position until removed therefrom,
   b. a valve assembly mounted in the housing and incorporating
      1. a liquid inlet portal connectable to a source of said liquid, and
      2. flow control means movable between a first flow stopping position and a second flow permitting position, and
   c. interlock means
      1. mounted in the housing and controllably connected to the flow control means of the valve assembly for preventing movement of said flow control means whenever desired,
      2. enabling the actuation of the flow control means only when the liquid transfer assembly is securely, matingly, cooperatingly mounted in the desired interengagement with the liquid delivery/filling assembly, and
      3. comprising disconnection preventing means which are automatically activated during the actuation of said flow control means and prevent separation of the liquid transfer assembly from the liquid delivery/filling assembly whenever the desired liquid is flowing therethrough;

C. an active reservoir adaptor constructed for secure mounted engagement in any desired reservoir, and comprising
   a. a housing mountable in the reservoir and incorporating a liquid delivery/filling assembly receiving surface constructed for mating, engaged contacting relationship therewith,
   b. an elongated tube member mounted to the housing and movable between a first sealed position and a second liquid flow position, and
   c. spring means mounted between the housing and the tube member for normally biasing the tube member into its first, sealed position, whereby assurance is provided that the integrated, cooperating liquid flow controlling system of this invention is securely mounted in the precisely desired position prior to enabling any liquid flow to occur.

* * * * *